US009945218B2

(12) United States Patent
Tolman et al.

(10) Patent No.: US 9,945,218 B2
(45) Date of Patent: Apr. 17, 2018

(54) SYTEMS AND METHODS FOR RE-COMPLETING MULTI-ZONE WELLS

(71) Applicants: Randy C. Tolman, Spring, TX (US); Renzo M. Angeles Boza, Houston, TX (US); Kris J. Nygaard, Houston, TX (US); Christian Mayer, Pearland, TX (US); Abdel Wadood M. El-Rabaa, Plano, TX (US)

(72) Inventors: Randy C. Tolman, Spring, TX (US); Renzo M. Angeles Boza, Houston, TX (US); Kris J. Nygaard, Houston, TX (US); Christian Mayer, Pearland, TX (US); Abdel Wadood M. El-Rabaa, Plano, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 486 days.

(21) Appl. No.: 14/405,132

(22) PCT Filed: Jun. 24, 2013

(86) PCT No.: PCT/US2013/047376
§ 371 (c)(1),
(2) Date: Dec. 2, 2014

(87) PCT Pub. No.: WO2014/031223
PCT Pub. Date: Feb. 27, 2014

(65) Prior Publication Data

US 2015/0315890 A1 Nov. 5, 2015

Related U.S. Application Data

(60) Provisional application No. 61/692,529, filed on Aug. 23, 2012.

(51) Int. Cl.
*E21B 43/25* (2006.01)
*E21B 47/06* (2012.01)
(Continued)

(52) U.S. Cl.
CPC ..... *E21B 43/25* (2013.01); *E21B 33/124* (2013.01); *E21B 43/10* (2013.01); *E21B 43/11* (2013.01); *E21B 43/14* (2013.01); *E21B 47/06* (2013.01)

(58) Field of Classification Search
CPC ..... E21B 43/14; E21B 33/124; E21B 43/10; E21B 43/11; E21B 43/25
See application file for complete search history.

(56) References Cited

U.S. PATENT DOCUMENTS 3,191,680 A 6/1965 Vincent
5,273,115 A 12/1993 Spafford
(Continued)

*Primary Examiner* — Caroline N Butcher
(74) *Attorney, Agent, or Firm* — ExxonMobil Upstream Research Company—Law Department

(57) ABSTRACT

The well includes a wellbore with a casing string that extends within the wellbore, defining a casing conduit including existing perforations. A re-completion liner extends within the casing conduit and defines a liner conduit therein, and an annular space extends between the re-completion liner and the casing string. Systems and methods include perforating the re-completion liner to create liner perforations and perforating the casing string to create re-completion perforations that are generally aligned with respective liner perforations, stimulating the subterranean formation by flowing a completing fluid through the plurality of liner perforations and re-completion perforations, controlling flow of a fluid within the annular space, and/or producing a reservoir fluid from the subterranean formation and through both the existing perforations and the re-completion perforations.

13 Claims, 10 Drawing Sheets

(51) Int. Cl.

| | |
|---|---|
| ***E21B 33/124*** | (2006.01) |
| ***E21B 43/14*** | (2006.01) |
| ***E21B 43/10*** | (2006.01) |
| ***E21B 43/11*** | (2006.01) |

(56) References Cited

U.S. PATENT DOCUMENTS

| | | | | |
|---|---|---|---|---|
| 5,337,808 | A | 8/1994 | Graham | |
| 5,456,319 | A | 10/1995 | Schmidt et al. | |
| 5,615,739 | A | 4/1997 | Dallas | |
| 5,669,448 | A | 9/1997 | Minthorn et al. | |
| 6,257,332 | B1 | 7/2001 | Vidrine et al. | |
| 7,419,223 | B2 | 9/2008 | Seams | |
| 2001/0050172 | A1* | 12/2001 | Tolman | E21B 17/203 166/297 |
| 2003/0106689 | A1* | 6/2003 | Nguyen | C09K 8/80 166/278 |
| 2004/0188093 | A1* | 9/2004 | Funchess | E21B 43/08 166/299 |
| 2007/0039729 | A1 | 2/2007 | Watson et al. | |
| 2010/0258316 | A1 | 10/2010 | Lockhart et al. | |
| 2010/0258317 | A1 | 10/2010 | Lockhart et al. | |
| 2011/0056700 | A1 | 3/2011 | Mathiesen et al. | |
| 2011/0198083 | A1 | 8/2011 | Lockhart et al. | |
| 2011/0272153 | A1 | 11/2011 | Boone et al. | |
| 2012/0103607 | A1 | 5/2012 | Fitzpatrick et al. | |

* cited by examiner

SYTEMS AND METHODS FOR RE-COMPLETING MULTI-ZONE WELLS

CROSS REFERENCE TO RELATED APPLICATIONS

This application is the National Stage entry under 35 U.S.C. 371 of PCT/US2013/047376, filed Jun. 24, 2013, which claims the benefit of U.S. Provisional Patent Application No. 61/692,529, filed Aug. 23, 2012, the disclosure of which is hereby incorporated by reference.

FIELD OF THE DISCLOSURE

The present disclosure is directed to systems and methods for re-completing a well, and more particularly to systems and methods that include re-lining a casing string that includes a plurality of existing perforations prior to re-completing the well.

BACKGROUND OF THE DISCLOSURE

Many wells, such as oil wells, are completed using a multi-zone stimulation technique. Multi-zone stimulation techniques may utilize stimulation operations to stimulate specific, or target, zones of a subterranean formation and/or may restrict a flow of a reservoir fluid from a subterranean formation and into a casing string, or liner, that lines a wellbore to specific, or target, locations along a length of the casing string or liner.

While the stimulation operations, which may include fracture treatments and/or acid treatments, may be effective at stimulating the target zones of the subterranean formation, portions, which may be significant portions, of the subterranean formation may remain unstimulated. Thus, the reservoir fluid only may be produced from a fraction of the subterranean formation and/or a rate of reservoir fluid production from one or more unstimulated zones of the subterranean formation may be significantly less than a rate of reservoir fluid production from the stimulated zones of the subterranean formation.

Therefore, after initial production of reservoir fluids from the subterranean formation for at least an initial production time, it may be desirable to re-complete the subterranean formation to stimulate the one or more unstimulated zones of the subterranean formation, to increase a rate of reservoir fluid production from the one or more unstimulated zones, and/or to re-stimulate a previously stimulated zone of the subterranean formation. However, and since the casing string and/or liner that is present within the wellbore may include a plurality of spaced-apart perforations that were utilized during the initial stimulation of and/or production from the subterranean formation, it may be difficult to effectively re-stimulate the one or more unstimulated zones of the subterranean formation. Thus, there exists a need for improved systems and methods for re-completing multi-zone wells.

SUMMARY OF THE DISCLOSURE

Systems and methods for re-completing a multi-zone well. The well includes a wellbore, which extends between a surface region and a subterranean formation, and a casing string that extends within the wellbore, defines a casing conduit, and includes existing perforations. A re-completion liner extends within the casing conduit and defines a liner conduit therein, and an annular space extends between the re-completion liner and the casing string. The systems and methods include perforating the re-completion liner to create liner perforations and perforating the casing string to create re-completion perforations that are generally aligned with respective liner perforations, stimulating the subterranean formation by flowing a completing fluid through the plurality of liner perforations and the plurality of re-completion perforations, controlling a flow of a fluid within the annular space, and/or producing a reservoir fluid from the subterranean formation and through both the existing perforations and the re-completion perforations.

In some embodiments, the perforating may include creating both a liner perforation and a respective generally aligned re-completion perforation with a single perforation element. In some embodiments, the single perforation element passes through the re-completion liner to create the liner perforation, passes through the annular space, and passes through the casing string to create the respective generally aligned re-completion perforation.

In some embodiments, the re-completing includes fracturing, acidizing, and/or otherwise stimulating portions of the subterranean formation via the plurality of liner and re-completion perforations. In some embodiments, the systems and methods may include delivering a completion fluid to the liner conduit at a supply flow rate to generate a positive pressure within the liner conduit. In some embodiments, the stimulating includes flowing the completing fluid through the plurality of liner perforations and the plurality of re-completion perforations at a completion flow rate that is greater than the supply flow rate.

In some embodiments, the systems and methods include inserting the re-completion liner into the casing conduit. In some embodiments, the methods do not include cementing or otherwise permanently sealing the re-completion liner within the casing conduit and/or sealing the existing perforations with cement or a similar sealant that remains in place after the re-completion is finished and/or after subsequent production has commenced. In some embodiments, controlling the flow of the fluid within the annular space may include generating a flow restriction within the annular space and/or removing the flow restriction from the annular space.

DETAILED DESCRIPTION AND BEST MODE OF THE DISCLOSURE

Figure 1:
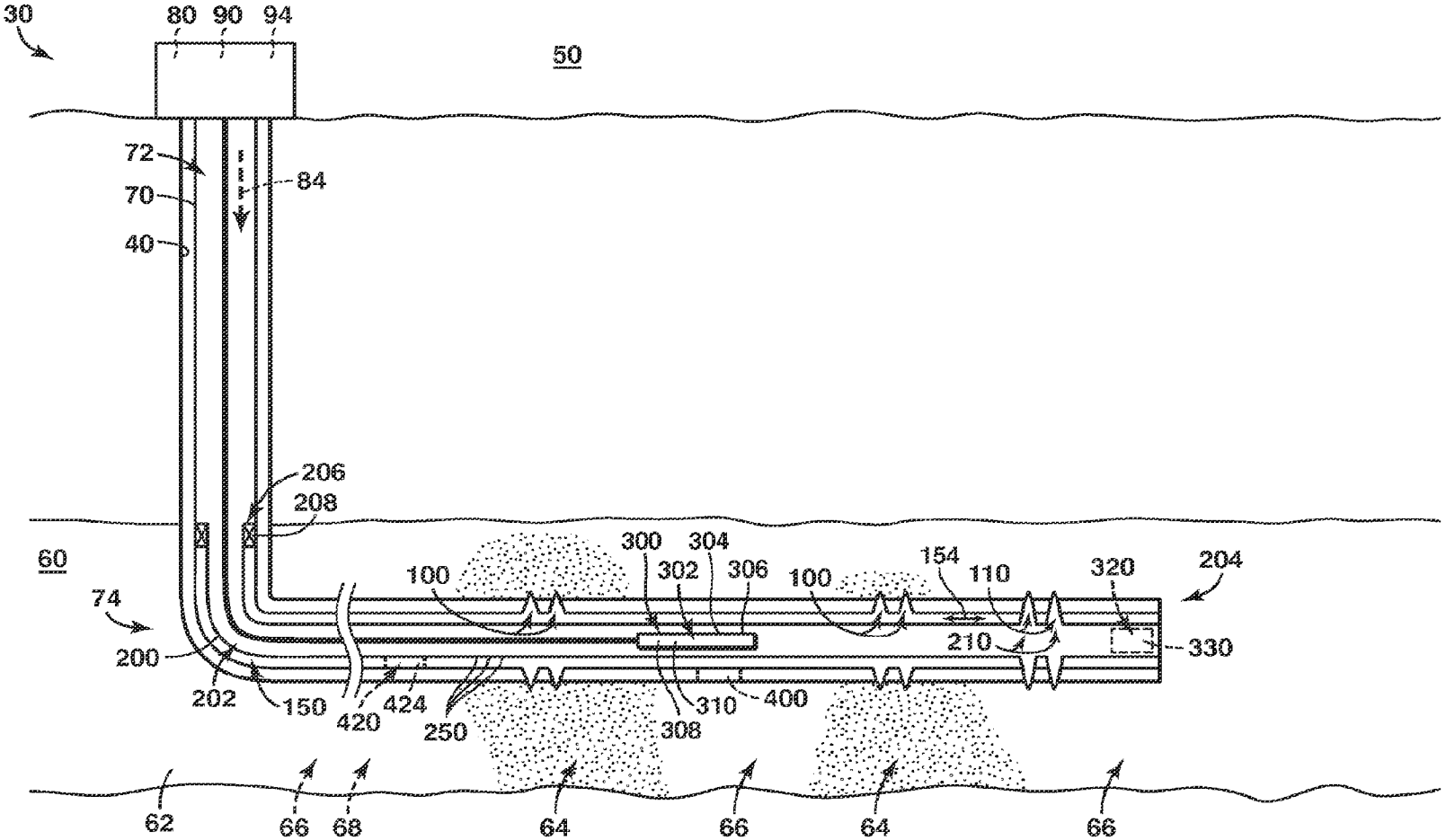
FIG. 1 provides illustrative, non-exclusive examples of a well that may be re-completed using the systems and methods according to the present disclosure.

FIG. 1 provides illustrative, non-exclusive examples of a well 30 that may be re-completed using the systems and methods according to the present disclosure. Well 30 includes a wellbore 40 that extends between a surface region 50 and a subterranean formation 60. A casing string 70 extends within wellbore 40 and defines a casing conduit 72 therewithin. Prior to re-completion of well 30, casing string 70 includes a plurality of existing perforations 100, which also may be referred to herein as initial perforations 100, while during and/or subsequent to re-completion of well 30, the casing string also includes a plurality of re-completion perforations 110.

Well 30 further includes a re-completion liner 200, which also may be referred to herein as a liner 200, that extends within at least a portion of casing conduit 72. A liner conduit 202 is defined within re-completion liner 200, and an annular space 150 is defined between casing conduit 72 and re-completion liner 200. At least one sealing device 206, such as a packer 208, may be located near an uphole end of re-completion liner 200 and may retain the re-completion liner within casing conduit 72 and/or fluidly isolate annular space 150 from liner conduit 202. Subsequent to re-completion of well 30, re-completion liner 200 includes a plurality of liner perforations 210 that are generally aligned with respective re-completion perforations 110 of casing string 70 and may provide fluid communication between liner conduit 202 and casing conduit 72.

During re-completion of well 30, a stimulation assembly 300 may be present therein. Stimulation assembly 300 may include any suitable structure that is configured to be utilized during, and/or aid in, the re-completion of well 30. As an illustrative, non-exclusive example, stimulation assembly 300 may include a perforation device 302 that is configured to produce a perforation element 304, with perforation element 304 producing re-completion perforations 110 and liner perforations 210. As discussed herein, the perforation element may create a plurality of liner perforations and a respective plurality of re-completion perforations that are generally aligned with the plurality of liner perforations. An illustrative, non-exclusive example of perforation device 302 is a perforation gun 306 that includes a plurality of perforation elements 304 in the form of perforation charges 308. Another illustrative, non-exclusive example of a perforation element includes an abrasive jet 310 that may be produced by perforation device 302.

As shown in dashed lines in FIG. 1, well 30 and/or liner conduit 202 thereof further may include, or contain, an isolation device 320, such as a plug 330 or other flow control device, that may be configured to fluidly isolate a downhole portion of liner conduit 202 from an uphole portion of the liner conduit. As illustrated in FIG. 1, plug 330 may be located near a terminal end 204 of well 30 and/or liner conduit 202. However, it is within the scope of the present disclosure that plug 330 may be present at any suitable location within well 30 and/or that the plug may fluidly isolate any suitable downhole portion of well 30 from any suitable uphole portion of well 30.

Prior to the creation of liner perforations 210, and as discussed in more detail herein, the presence of plug 330 within liner conduit 202 may provide for pressurization of liner conduit 202, such as through the use of a pump 80, which may provide a fluid 84 to casing conduit 72 and/or liner conduit 202. Subsequent to the creation of liner perforations 210 and re-completion perforations 110, and as also discussed in more detail herein, fluid 84 may flow through liner perforations 210, through annular space 150, through re-completion perforations 110, and into the subterranean formation to stimulate the subterranean formation. Illustrative, non-exclusive examples of fluids 84 that may be provided by pump 80 include completion fluids, stimulant fluids, fracturing fluids, water, fluids that contain a proppant, and/or acids. As such fluid 84 may be and/or include any suitable fluid associated with a well stimulation, perforation, and/or completion operation.

Subterranean formation 60 may be and/or include any suitable subterranean structure that may include or contain at least a portion of well 30. Subterranean formation 60 may include or contain a reservoir fluid 62, and well 30 may be configured to remove reservoir fluid 62 from the subterranean formation and provide the reservoir fluid to and/or proximal to surface region 50. This process may be referred to herein as producing the reservoir fluid from the subterranean formation. Illustrative, non-exclusive examples of reservoir fluids according to the present disclosure include any suitable hydrocarbon, liquid hydrocarbon, gaseous hydrocarbon, light gas, light oil, shale gas, shale oil, and/or coal bed methane.

As discussed, the systems and methods disclosed herein may be directed to re-completion of well 30. This may include re-completing well 30 after well 30 has been constructed, has experienced an initial completion and/or stimulation process, and/or has been utilized to produce reservoir fluid 62 from subterranean formation 60 for an initial production time. Thus, and prior to re-completion of well 30, subterranean formation 60 may include one or more stimulated zones 64 and one or more unstimulated zones 66. As used herein, stimulated zones 64 may refer to portions of subterranean formation 60 that are in fluid communication with existing perforations 100, are in direct fluid communication with existing perforations 100, were stimulated during the initial completion and/or stimulation process, produced reservoir fluid during the initial production time, were depleted of reservoir fluid during the initial production time, and/or had a concentration of reservoir fluid that is contained therein decreased, and/or decreased to below a threshold reservoir fluid concentration, during the initial production time. Stimulated zones 64 also may be referred to herein as stimulated regions, stimulated portions, and/or stimulated intervals of the subterranean formation.

In contrast, and as used herein, unstimulated zones 66 may refer to portions of subterranean formation 60 that are not in fluid communication with existing perforations 100, are not in direct fluid communication with existing perforations 100, were not stimulated during the initial completion and/or stimulation process, were not effectively stimulated during the initial completion and/or stimulation process, did not produce reservoir fluid during the initial production time, were not depleted of reservoir fluid during the initial production time, and/or did not have the concentration of reservoir fluid that is contained therein decreased to below a threshold reservoir fluid concentration during the initial production time. Unstimulated zones 66 also may be referred to herein as unstimulated regions, unstimulated portions, and/or unstimulated intervals of the subterranean formation.

Thus, and as illustrated in FIG. 1, re-completion of well 30 may include creation of re-completion perforations 110 and liner perforations 210 to provide for stimulation of and/or production of reservoir fluid 62 from unstimulated zones 66 of subterranean formation 60. Additionally or alternatively, it is also within the scope of the present disclosure that re-completion of well 30 may be utilized to re-stimulate stimulated zones 64, such as to improve and/or increase the production of reservoir fluids 62 therefrom, and/or to isolate one or more unproductive zones 68 from fluid communication with liner conduit 202.

As used herein, unproductive zones 68 may refer to zones of subterranean formation 60 that are not producing a reservoir fluid and/or are not producing a desired reservoir fluid. As illustrative, non-exclusive examples, the unproductive zone may produce water instead of a hydrocarbon, may produce a greater concentration of water than is desired, may produce a gaseous hydrocarbon instead of a liquid hydrocarbon, and/or may produce a liquid hydrocarbon instead of a gaseous hydrocarbon.

Annular space 150 is defined between casing string 70 and re-completion liner 200. As discussed in more detail herein, annular space 150 may define a fluid conduit that extends along at least a portion of a length of the re-completion liner. More specifically, such a fluid conduit extends along the exterior of the re-completion liner and the interior of the casing string. Illustrative, non-exclusive examples of the portion of the length of the re-completion liner include at least 10%, at least 20%, at least 30%, at least 40%, at least 50%, at least 60%, at least 70%, at least 80%, at least 90%, at least 95%, at least 97.5%, or at least 99% of the length of the re-completion liner.

Annular space 150 may include an open, or unoccluded, annular space that provides for at least substantially free flow of an annulus fluid therewithin. Thus, annular space 150 may provide fluid communication between existing perforations 100 and re-completion perforations 110, between existing perforations 100 and liner perforations 210, and/or between re-completion perforations 110 and liner perforations 210.

Additionally or alternatively, and as also discussed in more detail herein, annular space 150 may be configured to limit, restrict, block, occlude, and/or otherwise control fluid flow therein in a direction that is parallel to a longitudinal axis of the annular space, which also may be referred to herein as a longitudinal and/or axial direction 154. As an illustrative, non-exclusive example, the annular space may include one or more flow control materials 400 and/or one or more flow control devices 420. As another illustrative, non-exclusive example, a dimension of the annular space may be selected to limit fluid flow therein. As also discussed in more detail herein, the fluid flow within annular space 150 may be limited, restricted, blocked, and/or occluded temporarily, such as during re-completion of well 30, or permanently. When the fluid flow within the annular space is only temporarily limited, restricted, blocked, and/or occluded, such as during re-completion of well 30, it is within the scope of the present disclosure to remove and/or deactuate any corresponding flow control materials and/or flow control devices to permit flow of fluid through the annular space after re-completion of the well, such as to fluids to flow through the annular space during production from the subterranean formation.

Illustrative, non-exclusive examples of flow control materials 400 according to the present disclosure include any suitable flow control fluid, cement, crosslinked gel, and/or particulate material. Illustrative, non-exclusive examples of flow control fluids include shear thickening fluids, Bingham fluids, Newtonian fluids, single-component fluids, multi-component fluids, and/or high viscosity fluids, including fluids with viscosities of at least 10 centipoise (cp), at least 15 cp, at least 20 cp, at least 25 cp, at least 30 cp, at least 35 cp, at least 40 cp, at least 45 cp, or at least 50 cp. Illustrative, non-exclusive examples of particulate materials include any suitable porous material, porous structure, granular material and/or sand. It is within the scope of the present disclosure that flow control materials 400 may be supplied to annular space 150 subsequent to formation of the annular space, that the flow control materials may be present within casing conduit 72 prior to formation of the annular space, and/or that the flow control materials may be operatively attached to re-completion liner 200 and/or supplied to the annular space concurrently with the formation of the annular space.

Illustrative, non-exclusive examples of flow control devices 420 according to the present disclosure include packers, swellable packers, swellable coatings, and/or hydraulically expanding collars 424. It is within the scope of the present disclosure that the flow control devices may be located within annular space 150 in any suitable manner. As an illustrative, non-exclusive example, the flow control devices may be operatively attached to and/or form a portion of re-completion liner 200 and located within the annular space concurrently with formation of the annular space. As another illustrative, non-exclusive example, the flow control devices may be located within casing conduit 72 prior to formation of annular space 150. As yet another illustrative, non-exclusive example, the flow control devices may be located within the annular space subsequent to formation of the annular space.

Re-completion liner 200 may include any suitable shape, cross-sectional shape, and/or structure. As an illustrative, non-exclusive example, the re-completion liner may include a constant cross-sectional shape along a length thereof. As another illustrative, non-exclusive example, the re-completion liner may include a varying, or tapered, profile, or outer diameter along a length thereof, with a downhole portion of the re-completion liner including a smaller outer diameter, or a smaller cross-sectional area, than an uphole portion of the re-completion liner. As an illustrative, non-exclusive example, this varying outer diameter may be accomplished by varying a wall thickness of the re-completion liner and/or by applying an external coating with a varying thickness to the re-completion liner. An internal diameter of the re-completion liner may be constant, or at least substantially constant, regardless of any potential variation in the outer diameter of the re-completion liner along the length thereof.

The re-completion liner may be formed from a plurality of liner segments 250 that may be operatively attached to one another, to respective coupling devices, and/or to flow control devices 420 to form the re-completion liner. It is within the scope of the present disclosure that the plurality of liner segments may be operatively attached to one another at a plurality of joints and that the plurality of joints may include and/or be flush joints that do not protrude past an outer diameter of the liner segments and/or an inner diameter of the liner segments. However, it is also within the scope of the present disclosure that the plurality of joints may include collars that extend past the outer diameter of the liner segments and/or the inner diameter of the liner segments. When the collars extend past the outside diameter of the liner segments, the collars may function as, include, and/or be flow control devices 420.

Re-completion liner 200 may be present in any suitable location within casing conduit 72 and/or within any suitable portion of the casing conduit. As illustrative, non-exclusive examples, the re-completion liner may be present within a portion of the casing conduit that includes existing perforations 100, in an entire region of the casing conduit that includes the existing perforations, in a portion of the casing conduit that is within a portion of the subterranean formation that includes reservoir fluid 62 (which also may be referred to herein as a pay zone), in a horizontal portion of the casing conduit, in a vertical portion of the casing conduit, and/or in a deviated portion of the casing conduit. As another illustrative, non-exclusive example, and as shown in FIG. 1, re-completion liner 200 may be hung off in a heel 74 of casing conduit 72 that is uphole from existing perforations 100 and may extend within the casing conduit and past a portion, a majority, or all of the existing perforations.

As indicated in dashed lines in FIG. 1, well 30 may include and/or be in communication with any suitable controller 90 that is programmed and/or configured to control the operation thereof. When utilized, this control may include, but is not limited to, regulating the flow of fluids into and/or out of the well, the introduction, use, and/or removal of devices within the wellbore, etc. As illustrative, non-exclusive examples, controller 90 may be programmed to control the operation of well 90 using any suitable portion of any of the methods that are discussed in more detail herein. As also indicated in dashed lines in FIG. 1, controller 90 may include and/or be in communication with one or more detectors 94, which may provide any suitable signal that is indicative of any suitable detected value to controller 90. Illustrative, non-exclusive examples of detected values according to the present disclosure include any suitable pressure, temperature, and/or flow rate that is within and/or associated with well 30, wellbore 40, casing conduit 72, liner conduit 202, and/or annular space 150. Illustrative, non-exclusive examples of detectors 94 according to the present disclosure include any suitable pressure detector, differential pressure detector, temperature detector, and/or flow meter.

As discussed in more detail herein, re-completion of well 30 may include stimulation and/or re-stimulation of one or more zones 64/66/68 of subterranean formation 60. As an illustrative, non-exclusive example, a suitable re-completion process may include perforating re-completion liner 200 and casing string 70 with perforation device 302 to produce liner perforations 210 and re-completion perforations 110, respectively. This perforating may be repeated any suitable number of times to produce any suitable number of perforations 110/210. Subsequent to formation of perforations 110/210, fluid 84 may be provided to casing conduit 72 and/or liner conduit 202 to pressurize the liner conduit and provide a motive force for flow of fluid 84 through perforations 110/210 and into subterranean formation 60. Under these conditions, control of the flow of fluid 84 within annular space 150, which may be accomplished using any suitable system and/or method, illustrative, non-exclusive examples of which are disclosed herein, may provide for delivery of a desired flow rate of fluid 84 through perforations 110/210 and into subterranean formation 60, thereby providing for a desired stimulation extent, stimulation efficiency, and/or stimulation rate of the subterranean formation.

As another illustrative, non-exclusive example, a suitable re-completion process may include creating a positive pressure within liner conduit 202 prior to formation of perforations 110/210 and maintaining the positive pressure within liner conduit 202 subsequent to formation of perforations 110/210. Under these conditions, creation of perforations 110/210 may initiate stimulation of subterranean formation 60 by providing, or creating, a fluid flow pathway between liner conduit 202 and the subterranean formation. The presence of the positive pressure within the liner conduit, together with the near-instantaneous formation of perforations 110/210 (which may be accomplished using an explosive device, such as perforation charge 308 of perforation gun 306), may create a pressure wave, pressure surge, and/or shockwave within fluid 84 that is present within liner conduit 202, thereby providing for rapid flow of fluid 84 through perforations 110/210.

Momentum of fluid 84 that flows through perforations 110/210 may create a "fluid hammer" or hydraulic shock effect, in which a majority of fluid 84 flows in a relatively straight line between liner perforations 210 and re-completion perforations 110, thereby decreasing a flow of fluid 84 within annular space 150 and decreasing a need for flow control within the annular space. In addition, the rapid flow of fluid 84, together with the great momentum thereof, may stimulate subterranean formation 60 more rapidly than may be accomplished if the positive pressure were not generated prior to formation of perforations 110/210. Moreover, in some embodiments and/or methods according to the present disclosure, the rapid flow of fluid 84 from the casing conduit through annular space 150 to the subterranean formation may draw fluid from the annular space into the formation. While not required to all embodiments or methods, the rapid flow of fluid 84 may create a venturi effect within the annular space, especially in uncemented or otherwise unsealed casings. When present, this effect may reduce the pressure in the annular space, and in some embodiments may even create a negative pressure within the annular space proximate the liner perforations and the generally aligned re-completion perforations. This pressure reduction and/or creation of negative pressure within the annular space may reduce or even negate the potential for flow of fluid 84 through the liner perforation and then (longitudinally) within (as opposed to through) the annular space.

Figure 5:
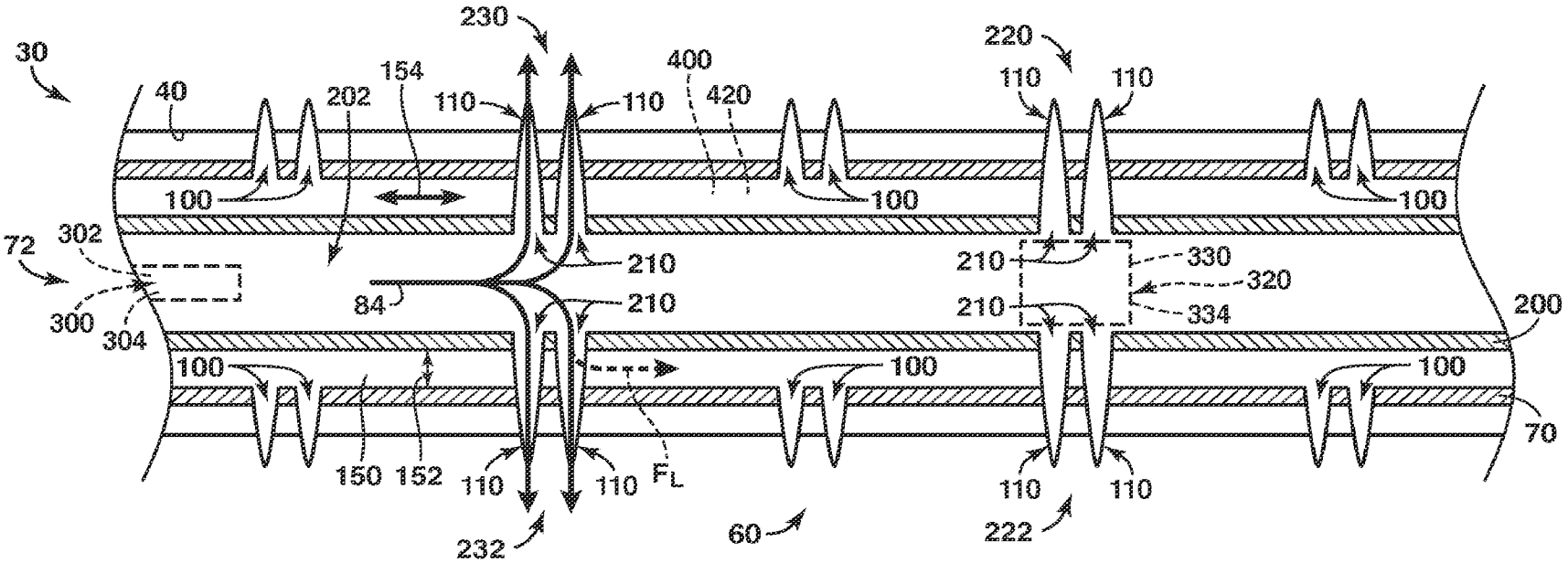
FIG. 5 provides illustrative, non-exclusive examples of a portion of a well that includes an annular space between a re-completion liner and a casing string and is being re-completed using the systems and methods according to the present disclosure.
Figure 6:
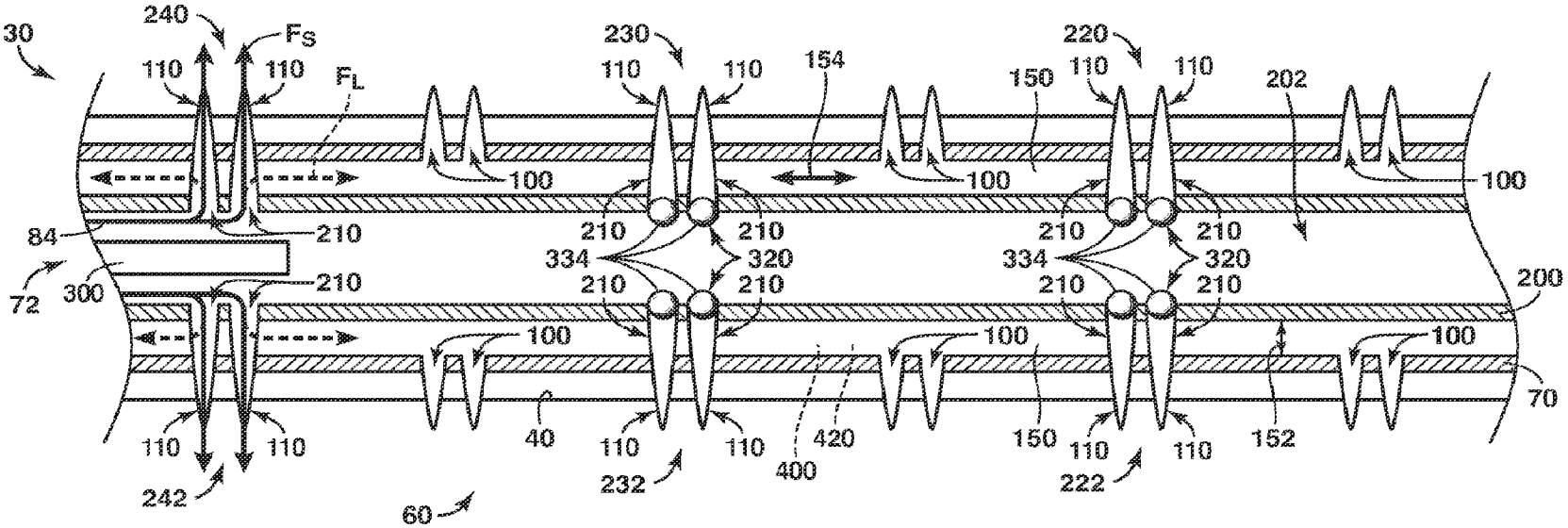
FIG. 6 provides additional illustrative, non-exclusive examples of a portion of a well that includes an annular space between a re-completion liner and a casing string and is being re-completed using the systems and methods according to the present disclosure.

As discussed, annular space 150 may be configured to, at least temporarily, control a fluid flow therein, such as during re-completion of well 30. FIGS. 2-4 and 7 provide illustrative, non-exclusive examples of systems and methods according to the present disclosure that may be utilized to control the fluid flow, while FIGS. 5-6 provide illustrative, non-exclusive examples of re-completion processes that may be performed using the systems and methods that are disclosed herein. It is within the scope of the present disclosure that the systems and methods that are discussed in more detail herein with reference to FIGS. 2-4 and 7 may be utilized with any suitable re-completion process, including those that are discussed in more detail herein with reference to FIGS. 1 and 5-6. In FIGS. 1-7, like numerals denote like, or similar, structures, and each structure may not be discussed in detail herein with reference to each Figure.

FIGS. 2-6 provide illustrative, non-exclusive examples of a portion of a well 30 that includes a wellbore 40 and a casing string 70 that extends within the wellbore. A recompletion liner 200 extends within at least a portion of the casing string (or a casing conduit 72 thereof) and defines an annular space 150 and a liner conduit 202.

Similar to FIG. 1, casing string 70 includes a plurality of existing perforations 100 and a plurality of re-completion perforations 110, with the plurality of re-completion perforations being formed during re-completion of well 30 and the plurality of existing perforations being formed prior to re-completion of well 30. Also similar to FIG. 1, re-completion liner 200 includes a plurality of liner perforations 210 that are formed during re-completion of well 30, with the plurality of re-completion perforations 110 being generally aligned with respective liner perforations 110.

As used herein, references to a plurality of re-completion perforations that are aligned, or generally aligned, with a corresponding, or respective, plurality of liner perforations does not require that each liner perforation is aligned with a re-completion perforation, or vice versa. In some systems and/or methods, this 1:1 correlation may be present, but it is not required. In other words, it is within the scope of the present disclosure that a plurality of liner perforations will be aligned, or generally aligned, with a corresponding, or respective, plurality of re-completion perforations, such as for flow of stimulating fluid therethrough during re-completion of the well and/or for the flow of reservoir fluid therethrough during production from the subterranean formation. However, there may be one or more liner perforations that do not align or otherwise correspond with a re-completion formation and/or vice versa without departing from the scope of the present disclosure.

As illustrated in FIGS. 2-3 and 5-6, re-completion of well 30 may include re-stimulation of subterranean formation 60 by creating liner perforations 210 and re-completion perforations 110 with a stimulation assembly 300 and providing a fluid 84 through liner perforations 210, through annular space 150, through re-completion perforations 110, and into the subterranean formation. Fluid 84 may be provided to liner conduit 202 at a total flow rate, $F_T$. A portion of the total flow rate may pass through annular space 150, through recompletion perforations 110, and into subterranean formation 60 as a stimulation flow, $F_S$. In addition, and when annular space provides for fluid communication between existing perforations 100 and re-completion perforations 110, a portion of the total flow may travel in longitudinal direction 154 within annular space 150 as leakage flow, $F_L$, which may exit the annular space through existing perforations 100.

Such a leakage flow may decrease stimulation flow $F_S$ for a given total flow rate $F_T$, thereby decreasing an efficiency of a stimulation process that may be associated with the re-completion operation. However, and subsequent to re-completion of well 30, it may be desirable to produce reservoir fluids from subterranean formation 60 through existing perforations 100 and re-completion perforations 110. Thus, the systems and methods disclosed herein may be utilized to limit, restrict, and/or otherwise control leakage flow $F_L$ during stimulation of well 30, limit, restrict, and/or otherwise control leakage flow $F_L$ during stimulation of well 30, and/or provide for re-completion of well 30 despite the presence of leakage flow $F_L$.

Figure 2:
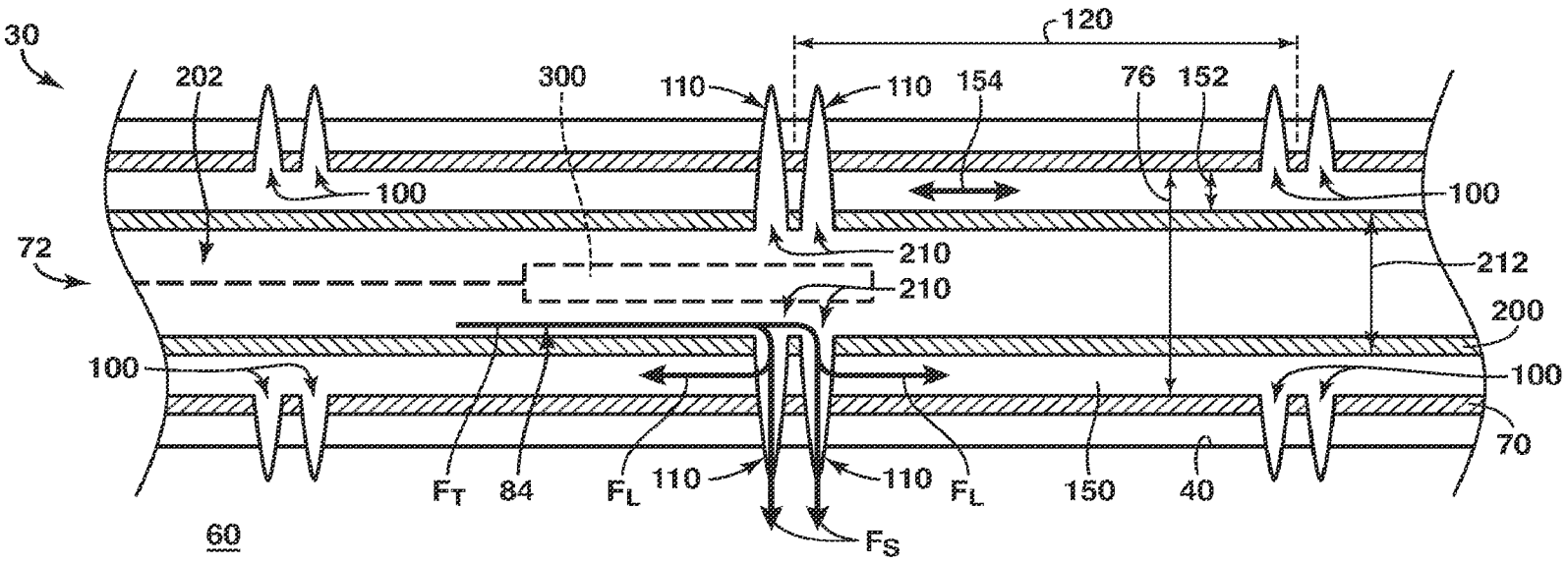
FIG. 2 provides illustrative, non-exclusive examples of a portion of a well that includes an annular space between a re-completion liner and a casing string according to the present disclosure.

FIG. 2 provides illustrative, non-exclusive examples of a well 30 that is configured to control leakage flow $F_L$. In FIG. 2, the leakage flow may be controlled by utilizing an annular space with a controlled, designed, and/or selected radial dimension 152 and/or by controlling an average distance 120 between existing perforations 100 and re-completion perforations 110 of casing string 70.

As an illustrative, non-exclusive example, radial dimension 152, which may define an average cross-sectional area for fluid flow in longitudinal direction 154 within annular space 150, may be selected, or sized, to control the leakage flow. This may include selecting radial dimension 152 based upon any suitable criteria, illustrative, non-exclusive examples of which include inner diameter 76 of casing string 70, a length of re-completion liner 200, average distance 120, a viscosity of an annulus fluid that may be present within annular space 150 during the re-completion operation, a number of zones of the subterranean formation that will be re-completed and/or re-stimulated, a distance between zones of the subterranean formation that will be re-completed and/or re-stimulated, and/or an average distance between the plurality of existing perforations and a closest one of the plurality of re-completion perforations that are formed during the re-completion of the well. As shown in FIG. 2, radial dimension 152 may be approximated as half of a difference between inner diameter 76 of casing string 70 and an outer diameter 212 of re-completion liner 200.

As another illustrative, non-exclusive example, average distance 120, which may define an average distance of a flow path between existing perforations 100 and liner perforations 210, may be selected to be greater than a threshold average distance, thereby providing at least a threshold resistance to the leakage flow. Illustrative, non-exclusive examples of threshold average distances according to the present disclosure include threshold average distances that are greater than an average distance between a given liner perforation and respective generally aligned re-completion perforation. This may include threshold average distances that are at least 2 times, at least 3 times, at least 4 times, at least 5 times, at least 6 times, at least 8 times, at least 10 times, at least 15 times, at least 20 times, at least 25 times, at least 50 times, at least 75 times, at least 100 times, at least 250 times, at least 500 times, or at least 1000 times greater than the average distance between the given liner perforation and the respective generally aligned re-completion perforation.

Additional illustrative, non-exclusive examples of threshold distances according to the present disclosure include threshold distances that are greater than a diameter of casing conduit 70 (such as inner diameter 76), greater than a diameter of liner conduit 202 (such as outer diameter 212), greater than a thickness of annular space 150 (such as radial dimension 152), and/or greater than a threshold average distance. Illustrative, non-exclusive examples of threshold average distances according to the present disclosure include threshold average distances of at least 1 meter (m), at least 2 m, at least 3 m, at least 4 m, at least 5 m, at least 10 m, at least 15 m, at least 20 m, at least 25 m, at least 30 m, at least 40 m, at least 50 m, at least 75 m, or at least 100 m.

In contrast, an average distance between a given re-completion perforation 110 and a respective generally aligned liner perforation 210 may be less than average distance 120. Illustrative, non-exclusive examples of the average distance between the given re-completion perforation and the respective generally aligned liner perforation include average distances of less than the diameter of the casing conduit, less than the diameter of the liner conduit, and/or average distances that are at least substantially equal to the thickness, or radial dimension, of the annular space.

As discussed, leakage flow FL also may be decreased, restricted, blocked, and/or controlled through the inclusion of one or more flow control materials 400 and/or flow control devices 420 within annular space 150. As also discussed, flow control materials 400 and/or flow control devices 420 may be configured to permanently restrict the leakage flow. Additionally or alternatively, the flow control materials and/or flow control devices also may be configured to temporarily restrict the leakage flow, such as during at least a portion, and optionally during all or substantially all, of the re-completion of well 30.

Figure 3:
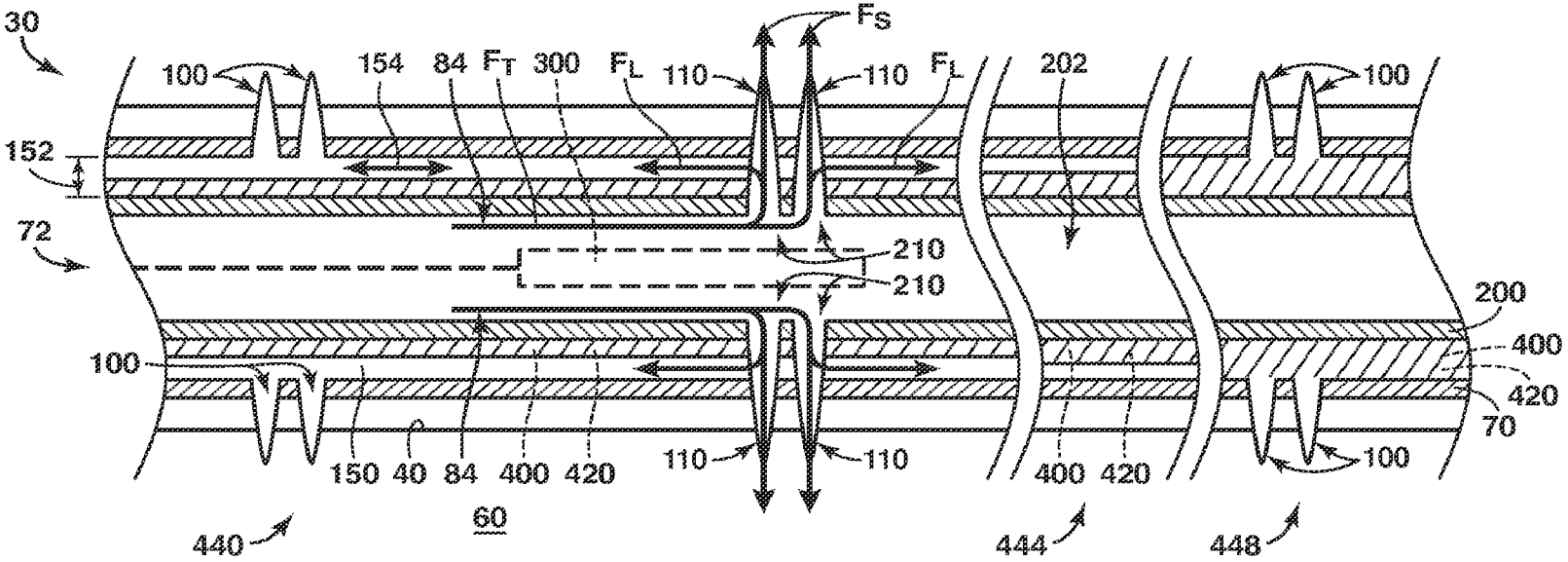
FIG. 3 provides illustrative, non-exclusive examples of a portion of a well that includes an annular space between a re-completion liner and a casing string that includes a continuous flow control device according to the present disclosure.

In the illustrative, non-exclusive example of FIG. 3, flow control material 400 and/or flow control device 420 are (at least substantially) continuous within annular space 150 in longitudinal direction 154. FIG. 3 further illustrates that flow control material 400 and/or flow control device 420 may extend across any suitable portion of radial dimension 152 of the annular space. This may include extending across a fraction of the annular space, as indicated at 440, extending across a majority of the annular space, as indicated at 444, and/or extending across the entire annular space, as indicated at 448.

As discussed, the presence of flow control material 400 and/or flow control device 420 within annular space 150 may restrict fluid communication between liner perforations 210 and existing perforations 100, thereby decreasing leakage flow FL and providing for supply of a greater proportion of total flow FT to subterranean formation 60 as stimulation flow FS during stimulation of the subterranean formation. As an illustrative, non-exclusive example and when flow control material 400 and/or flow control device 420 extends across less than the entire annular space (as indicated at 440 and 444) and/or includes a porous structure, the annular space may provide for a finite, or controlled, leakage flow FL of fluid 84 therein during stimulation of subterranean formation 60. Alternatively, and when flow control material 400 and/or flow control device 420 extends across the entire annular space (as indicated at 448), the leakage flow may be (at least substantially) blocked thereby.

Figure 4:
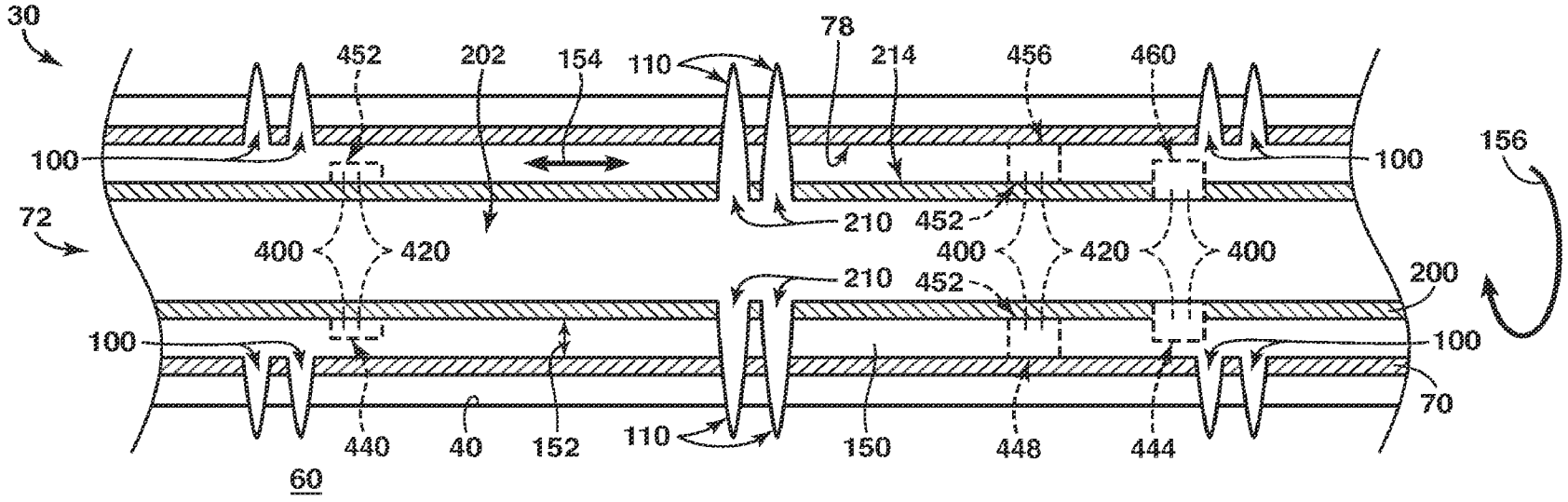
FIG. 4 provides illustrative, non-exclusive examples of a portion of a well that includes an annular space between a re-completion liner and a casing string that includes a discrete flow control device according to the present disclosure.

In the illustrative, non-exclusive example of FIG. 4, flow control material 400 and/or flow control device 420 may be discontinuous within annular space 150 in longitudinal direction 154 and/or in a circumferential direction 156 about an outer circumference 214 of re-completion liner 200 and/or about an inner circumference 78 of casing conduit 72. As an illustrative, non-exclusive example, flow control material 400 and/or flow control device 420 may be distributed at a plurality of discrete locations along a length of the re-completion liner.

As another illustrative, non-exclusive example, flow control material 400 and/or flow control device 420 may be present in a fraction of the length of the re-completion liner. Illustrative, non-exclusive examples of the fraction of the length of the re-completion liner include at least 10%, at least 20%, at least 30%, at least 40%, at least 50%, at least 60%, at least 70%, at least 80%, at least 90%, at least 95%, or at least 99% of the length of the re-completion liner.

As yet another illustrative, non-exclusive example, flow control material 400 and/or flow control device 420 may be present in a fraction of a circumference of annular space 150 and/or may be associated with a fraction of a circumference of re-completion liner 200. Illustrative, non-exclusive examples of the fraction of the circumference include at least 10%, at least 20%, at least 30%, at least 40%, at least 50%, at least 60%, at least 70%, at least 80%, at least 90%, at least 95%, or at least 99% of the circumference of the annular space and/or the circumference of the re-completion liner.

Similar to the illustrative, non-exclusive example of FIG. 3, FIG. 4 further illustrates that flow control material 400 and/or flow control device 420 may extend across any suitable portion of radial dimension 152 of annular space 150. This may include extending across a fraction of the annular space, as indicated at 440, extending across a majority of the annular space, as indicated at 444, and/or extending across the entire annular space, as indicated at 448. Additionally or alternatively, and as discussed, flow control material 400 and/or flow control device 420 may be operatively attached to re-completion liner 200, as indicated at 452, attached to casing string 70, as indicated at 456, and/or form a portion of re-completion liner 200, as indicated at 460.

FIG. 5 provides illustrative, non-exclusive examples of a portion of a well 30 that includes an annular space 150 between a re-completion liner 200 and a casing string 70 and is being re-completed using the systems and methods according to the present disclosure. In FIG. 5, casing string 70 includes a plurality of existing perforations 100, as well as a plurality of re-completion perforations 110. In addition, re-completion liner 200 includes a plurality of liner perforations 210, which are generally aligned with respective re-completion perforations 110 of casing string 70.

As discussed in more detail herein, existing perforations 100 may be present in casing string 70 prior to insertion of re-completion liner 200 therein. As also discussed in more detail herein, a stimulation assembly 300 may be configured to create liner perforations 210 and re-completion perforations 110 subsequent to insertion of the re-completion liner within the casing string. As an illustrative, non-exclusive example, stimulation assembly 300 may include a perforation device 302 that is configured to release a plurality of perforation elements 304, with each of the perforation elements creating both a liner perforation and a respective, generally aligned, re-completion perforation. As an illustrative, non-exclusive example, the perforation element may pass through the re-completion liner, thereby creating a re-completion perforation, and subsequently pass through the casing string, thereby creating a respective, generally aligned, re-completion perforation that is associated with the re-completion perforation and providing for the general alignment therebetween.

As shown in FIG. 5, re-completion liner 200 and casing string 70 may include one or more first perforations 220 that are associated with a first zone 222 of subterranean formation 60 and one or more second perforations 230 that are associated with a second zone 232 of the subterranean formation. During stimulation of subterranean formation 60, stimulation assembly 300 may be utilized to create first perforations 220, and fluid 84 may be provided to first zone 222 therethrough.

Subsequent to stimulation of first zone 222, an isolation device 320, such as a plug 330 and/or ball sealers 334, may be located within liner conduit 202 to fluidly isolate first perforations 220 from an uphole portion of the liner conduit. Then, stimulation assembly 300 may be utilized to create second perforations 230, and fluid 84 may be supplied to second zone 232 therethrough. This process may be repeated any suitable number of times, thereby creating any suitable number of liner perforations 210 and generally aligned re-completion perforations 110 and stimulating any suitable number of zones of subterranean formation 60. As discussed in more detail herein, leakage flow FL in longitudinal direction 154 within annular space 150 may be controlled in any suitable manner, such as through control of radial dimension 152 and/or through the inclusion of one or more flow control materials 400 and/or flow control devices 420 within the annular space.

FIG. 6 provides less schematic but still illustrative, non-exclusive examples of a portion of a well 30 that includes an annular space 150 between a re-completion liner 200 and a casing string 70 and is being re-completed using the systems and methods according to the present disclosure. In FIG. 6, first perforations 220 are associated with first zone 222 of subterranean formation 60, second perforations 230 are associated with second zone 232 of the subterranean formation, and third perforations 240 are associated with third zone 242 of the subterranean formation.

Stimulation of subterranean formation 60 may include creating a positive pressure within liner conduit 202, such as by providing fluid 84 thereto, prior to creation of perforations 220, 230, and 240. Subsequent to pressurization of the liner conduit, stimulation assembly 300 may create first perforations 220, and the positive pressure within liner conduit 202 may provide for supply of fluid 84 to first zone 222, thereby stimulating the first zone. After stimulation of first zone 222, isolation devices 320, such as ball sealers 334, may be provided to liner conduit 202 and may flow through the liner conduit to first perforations 220, thereby fluidly isolating liner conduit 202 from subterranean formation 60. This process may be repeated any suitable number of times, thereby creating any suitable number of liner perforations 210 and generally aligned re-completion perforations 110 and stimulating any suitable number of zones of subterranean formation 60.

As used herein, the phrase "positive pressure" may refer to a pressure within a portion of liner conduit 202 that is greater than and/or defined relative to a pressure within a portion, or zone, of subterranean formation 60 that includes the respective portion of the casing conduit. As such, a positive pressure within liner conduit 202 may provide a motive force for flow of fluid 84 from liner conduit 202 and into subterranean formation 60 when a fluid pathway therebetween, such as perforations 220, 230, and/or 240, is present.

As discussed in more detail herein, it is within the scope of the present disclosure that the positive pressure within liner conduit 202 may be maintained throughout an entire stimulation operation, which may include stimulation of a plurality of zones of subterranean formation 60. This positive pressure may provide a motive force to retain ball sealers 334 in a sealing configuration with respective liner perforations 210 and/or may provide a motive force for more effective stimulation of subterranean formation 60.

As an illustrative, non-exclusive example, creation of the positive pressure within liner conduit 202 prior to the formation of liner perforations 210 and respective generally aligned re-completion perforations 110 (and/or subsequent to sealing the perforations with ball sealers 334) may provide for greater stimulation flow, FS, immediately subsequent to creation of the perforations. As illustrative, non-exclusive examples, this may provide for utilization of the "fluid hammer" effect to provide a high stimulation flow, may provide for stimulation flows that are greater than a rate at which fluid 84 is provided to liner conduit 202, and/or may provide for supply of a majority of the fluid that is provided to the liner conduit to the subterranean formation as stimulation flow FS despite the presence of a fluid flow path within the annular space and between the liner perforation and the re-completion perforation, thereby decreasing a need for flow control material 400 and/or flow control device 420 within the annular space. Providing for this flow of the stimulation fluid at a stimulation flow rate that is greater than the supply flow rate may be accomplished through any suitable mechanism(s) and/or method(s). Illustrative, non-exclusive examples include, but are not limited to, one or more of the rate of delivery of stimulation fluid to the casing conduit, the pressure of the stimulation fluid within the casing conduit, compression of the stimulation fluid within the casing conduit, expansion/expandability of the casing responsive to fluid pressure within the casing conduit, the provision of compressible gases (such as nitrogen gas) to the casing conduit, etc.

Figure 7:
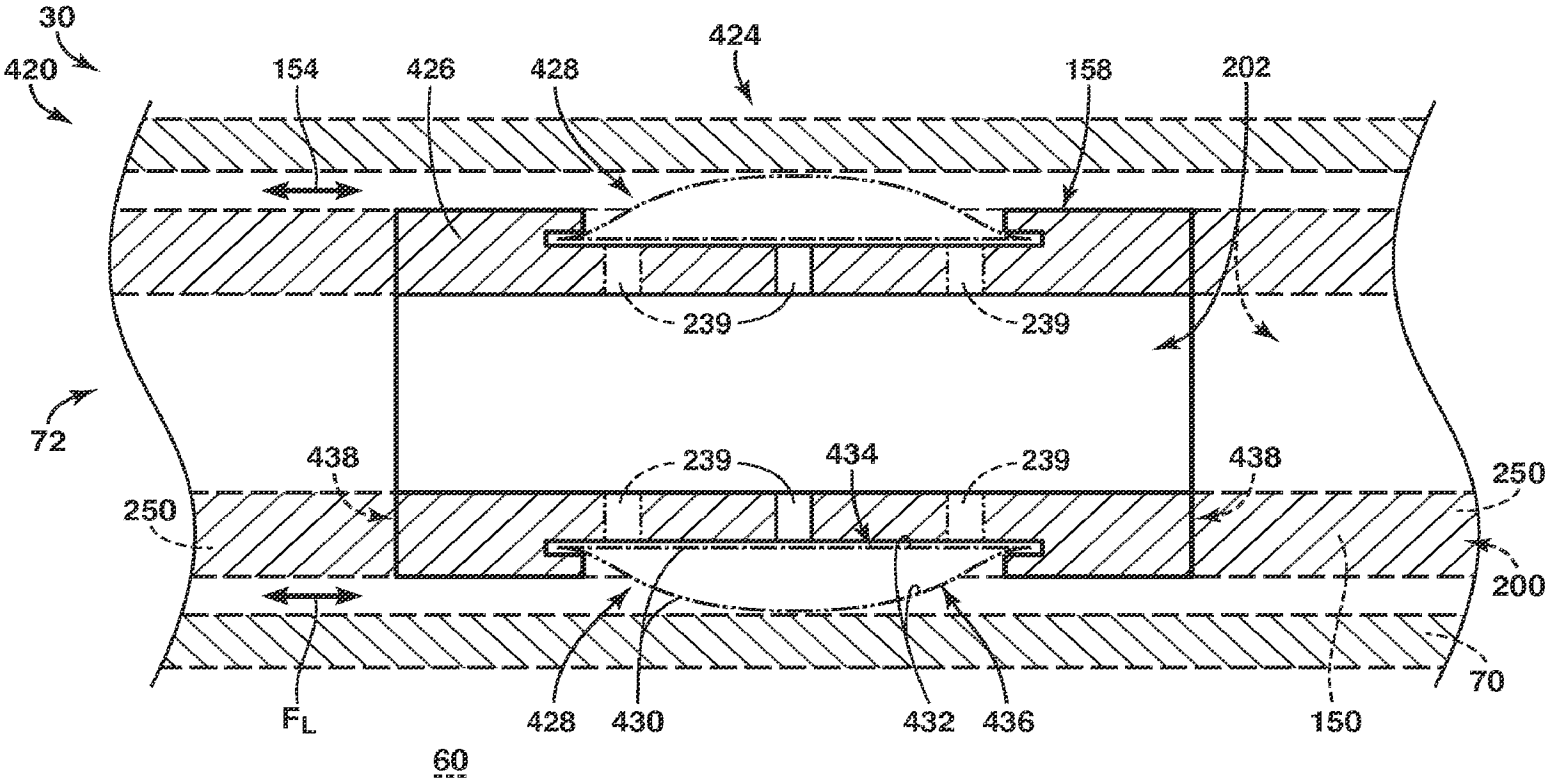
FIG. 7 provides an illustrative, non-exclusive example of a flow control device according to the present disclosure that is configured to control fluid flow within an annular space between a re-completion liner and a casing string.

FIG. 7 provides an illustrative, non-exclusive example of a flow control device 420 according to the present disclosure that is configured to selectively restrict a fluid flow, such as leakage flow FL, in longitudinal direction 154 within annular space 150. Flow control device 420, which may include and/or be a hydraulically expanding collar 424, may be utilized with any of the systems and methods that are disclosed herein and may form a portion of a re-completion liner 200 that may extend within a casing string 70.

Hydraulically expanding collar 424 includes a body 426 that defines a portion of liner conduit 202 and a portion of an inner bound 158 of annular space 150. The hydraulically expanding collar further includes a sealing structure 428 that includes a first surface 430 and an opposed second surface 432, with first surface 430 forming a portion of inner bound 158 and second surface 432 being in fluid communication with liner conduit 202. Hydraulically expanding collar 424 further may include one or more flanges 438 that are configured to operatively attach to one or more liner segments 250 of re-completion liner 200 and/or may include one or more orifices 239 that are configured to provide the fluid communication between liner conduit 220 and second surface 432.

Sealing structure 428 is configured to be actuated and/or otherwise transitioned from a contracted configuration 434 (as shown in dash-dot lines in FIG. 7) to a sealing configuration 436 (as shown in dash-dot-dot lines in FIG. 7) when a pressure within liner conduit 202 is greater than a pressure within annular space 150 by at least a threshold pressure, which also may be referred to herein as a threshold pressure differential between the liner conduit and the annular space and/or as a threshold positive pressure within the liner conduit. In contracted configuration 434, sealing structure 428 may not restrict, or at least may not significantly restrict, the fluid flow therepast, while in sealing configuration 436, the sealing structure may restrict, limit, occlude, and/or block the fluid flow therepast, at least to a greater extent than when in the contracted configuration.

Sealing structure 428 may include any suitable structure and/or be formed from any suitable material that is configured to transition between contracted configuration 434 and sealing configuration 436. As an illustrative, non-exclusive example, sealing structure 428 may include and/or be a resilient sealing structure that is configured to return to the retracted configuration when the pressure within liner conduit 202 is less than the threshold pressure. As another illustrative, non-exclusive example, sealing structure 428 may be configured to remain in sealing configuration 436 once transitioned thereto and/or to remain in the sealing configuration even if the pressure within liner conduit 202 returns to a value that is less than the threshold pressure. As yet another illustrative, non-exclusive example, sealing structure 428 may be formed from any suitable rubber, polymer, elastomer, plastic, and/or metal.

Figure 8:
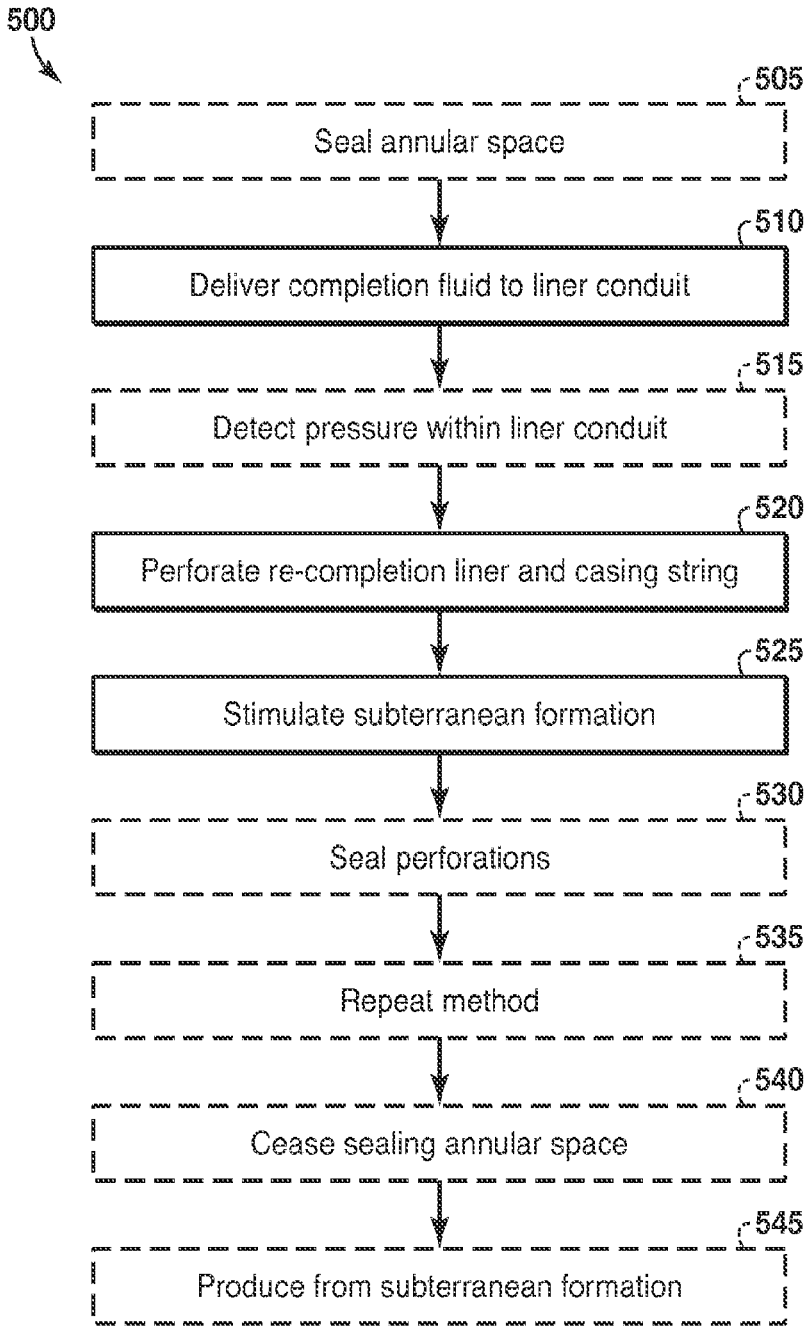
FIG. 8 is a flowchart depicting methods according to the present disclosure of re-stimulating a re-lined well.

FIG. 8 provides illustrative, non-exclusive examples of methods 500 according to the present disclosure of re-stimulating a re-lined well. As discussed, the well may include a wellbore, extends between a surface region and a subterranean formation, and a casing string that extends within the wellbore and defines a casing conduit therein. A re-completion liner may extend within a portion of the casing conduit and define an annular space between the re-completion liner and the casing string, as well as a liner conduit that extends within the re-completion liner.

Methods 500 may include sealing the annular space at 505 and include delivering a completion fluid to the liner conduit at 510. Methods 500 also may include detecting a pressure within the liner conduit at 515 and include perforating the re-completion liner and the casing string to create a plurality of liner perforations within the recompletion liner and a plurality of respective generally aligned re-completion perforations within the casing string at 520. Methods 500 further include stimulating the subterranean formation at 525 and may include sealing the plurality of liner perforations at 530, repeating the method at 535, ceasing the sealing of the annular space at 540, and/or producing a reservoir fluid from the subterranean formation at 545.

Sealing the annular space at 505 may include the use of any suitable sealing material and/or flow control device, illustrative, non-exclusive examples of which are discussed in more detail herein, to seal at least a portion of the annular space, such as to restrict, decrease, block, prevent, and/or occlude a flow of a fluid therepast. This may include sealing the annular space to restrict the flow of the fluid in a longitudinal direction within the annular space. Illustrative, non-exclusive examples of the portion of the annular space include at least 10%, at least 20%, at least 30%, at least 40%, at least 50%, at least 60%, at least 70%, at least 80%, at least 90%, at least 95%, at least 97.5%, or at least 99% of the annular space, or a total volume thereof, as well as less than 90%, less than 80%, less than 70%, less than 60%, less than 50%, less than 40%, less than 30%, less than 20%, less than 10%, less than 5%, or less than 1% of the annular space, or the total volume thereof.

It is within the scope of the present disclosure that the sealing may include permanently sealing the portion of the annular space. However, it is also within the scope of the present disclosure that, as discussed in more detail herein with reference to ceasing the sealing at 540, the sealing may include temporarily sealing the portion of the annular space, such as during the perforating at 520 and/or during the stimulating at 525. When temporary seals are utilized, the methods may include removing the temporary seals, such as prior to and/or during production of fluid from the subterranean formation.

Delivering the completion fluid to the liner conduit at 510 may include delivering the completion fluid at a supply flow rate to generate a positive pressure within the liner conduit. As discussed in more detail herein, the positive pressure may be greater than and/or defined relative to a pressure within the subterranean formation. Thus, generating the positive pressure may include generating a positive pressure within the liner conduit that is greater than a corresponding pressure within the subterranean formation, such as a pressure in a portion of the subterranean formation that is proximal to a portion of the liner conduit that includes the positive pressure.

It is within the scope of the present disclosure that the delivering may include flowing the completion fluid through the liner conduit and in contact with an internal surface of the re-completion liner and/or the casing string over at least a portion of a distance between the surface region and a portion of the re-completion liner that will be perforated during the perforating. Illustrative, non-exclusive examples of the portion of the distance include at least 50%, at least 60%, at least 70%, at least 80%, at least 90%, at least 95%, at least 99%, or substantially all of the distance between the surface region and the portion of the re-completion liner.

Additionally or alternatively, it is also within the scope of the present disclosure that the delivering may include maintaining the positive pressure during at least a portion of the method. As an illustrative, non-exclusive example, the maintaining may include maintaining the positive pressure during a majority, at least 50%, at least 60%, at least 70%, at least 80%, at least 90%, at least 95%, at least 99%, or all of a time period during which the method is being performed. As another illustrative, non-exclusive example, the maintaining may include delivering the completion fluid and/or delivering additional completion fluid immediately prior to the perforating, during the perforating, and/or during the stimulating.

Detecting the pressure within the liner conduit at 515 may include the use of any suitable system and/or method to detect any suitable pressure within the liner conduit. As an illustrative, non-exclusive example, the detecting may utilize a pressure detector to detect the pressure within the liner conduit and/or a pressure that is representative of and/or associated with the pressure within the liner conduit.

Perforating the re-completion liner and the casing string at 520 may include the use of any suitable perforation device, illustrative, non-exclusive examples of which are discussed in more detail herein, to create a plurality of liner perforations and a plurality of respective generally aligned re-completion perforations within the re-completion liner and the casing string, respectively. As discussed in more detail herein, this may include creating a respective liner perforation of the plurality of liner perforations and a respective generally aligned re-completion perforation of the plurality of re-completion perforations with a single perforation element, such as a perforation charge of a perforation gun and/or an abrasive jet. Thus, the perforation element may pass through the re-completion liner, creating the respective liner perforation, and subsequently pass through the casing string, creating the respective generally aligned re-completion perforation.

The plurality of liner perforations may include at least a first liner perforation and a second liner perforation. Similarly, the plurality of re-completion perforations may include at least a first re-completion perforation, which is generally aligned with the first liner perforation and a second re-completion perforation, which is generally aligned with the second liner perforation.

It is within the scope of the present disclosure that the perforating may be initiated responsive, responsive at least in part, or directly responsive, to any suitable criteria. As an illustrative, non-exclusive example, and when the perforating is performed by a perforation device, the perforating may be initiated responsive to the perforation device being located within a desired, or target, region of the subterranean formation, such as within an unstimulated portion of the subterranean formation and/or within a portion of the subterranean formation that is to be re-stimulated. In this context, in addition and/or in the alternative to being used to stimulate previously unstimulated regions of the subterranean formation, the systems and/or methods of the present disclosure may be used to re-stimulate zones that have already been completed/stimulated, such as by providing additional fracturing, stimulation, etc. to a region that is believed to have been understimulated and/or incompletely stimulated in a prior completion and/or to fracture and/or stimulate additional subregions within a previously completed region of the formation. As another illustrative, non-exclusive example, the perforating may be initiated responsive to the detecting at 515 and/or responsive to detecting that the positive pressure is greater than a threshold positive pressure.

Stimulating the subterranean formation at 525 may include flowing, or otherwise providing, the completion fluid from the liner conduit, through the plurality of liner perforations, through the annular space, through the respective generally aligned re-completion perforations, and into the subterranean formation. As an illustrative, non-exclusive example, and as discussed in more detail herein, the completion fluid may include a stimulant fluid, and the stimulating may include fracturing the subterranean formation and/or acidizing the subterranean formation with the stimulant fluid.

It is within the scope of the present disclosure that the simulating may include flowing the completion fluid at any suitable completion flow rate, which also may be referred to herein as a stimulation flow rate. As an illustrative, non-exclusive example, and as discussed in more detail herein, generating the positive pressure may provide for flowing the completion fluid at a completion flow rate that is, at least temporarily, greater than the supply flow rate, flowing the completion fluid immediately subsequent to and/or directly responsive to formation of the plurality of liner perforations and the respective plurality of generally aligned re-completion perforations, and/or flowing the completion fluid without ramping a flow of the completion fluid from a pump that is utilized to accomplish the flowing. This may provide for use of the fluid hammer effect to rapidly stimulate the subterranean formation upon creation of the liner and re-completion perforations and/or may decrease a potential for leakage of the completion fluid within the annular space subsequent to the perforating.

As another illustrative, non-exclusive example, the completion flow rate may be greater than a threshold completion flow rate and/or greater than the threshold completion flow rate for at least a threshold simulation time. Illustrative, non-exclusive examples of the threshold completion flow rates include threshold completion flow rates of at least 15 barrels per minute (BPM), at least 20 BPM, at least 25 BPM, at least 30 BPM, at least 35 BPM, or at least 40 BPM. Illustrative, non-exclusive examples of threshold completion times include threshold completion times of at least 1 second, at least 2 seconds, at least 3 seconds, at least 5 seconds, at least 10 seconds, at least 15 seconds, at least 20 seconds, at least 30 seconds, at least 40 seconds, at least 50 seconds, or at least 60 seconds.

Sealing the plurality of liner perforations at 530 may include the use of any suitable sealing agent to seal the plurality of liner perforations. As an illustrative, non-exclusive example, the sealing may include providing a plurality of ball sealers to the liner conduit to seal the plurality of perforations.

It is within the scope of the present disclosure that the sealing may be initiated responsive to any suitable criteria. As an illustrative, non-exclusive example, the sealing may be initiated responsive to flowing at least a threshold volume of completion fluid into the subterranean formation. As another illustrative, non-exclusive example, the sealing may be initiated responsive to flowing the completion fluid for at least a threshold stimulation time. As yet another illustrative, non-exclusive example, the sealing may be initiated responsive to detecting that the pressure within the liner conduit is less than a threshold pressure.

Repeating the method at 535 may include repeating any suitable portion of the method. As an illustrative, non-exclusive example, the stimulating may include stimulating a first zone of the subterranean formation that is associated with a first region of the re-completion liner and the repeating may include stimulating a second zone of the subterranean formation that is associated with a second region of the re-completion liner. This may include moving a stimulation assembly that is configured to perform the perforating from the first region to the second region prior to and/or as part of the repeating. As another illustrative, non-exclusive example, the second region may be different from and/or uphole from the first region.

Additionally or alternatively, the plurality of liner perforations may be a first plurality of liner perforations and the repeating may include repeating the method to create a second plurality of liner perforations within the second region of the re-completion liner. It is within the scope of the present disclosure that the repeating may be initiated based, at least in part, on any suitable criteria. As an illustrative, non-exclusive example, and subsequent to the sealing at 530, the positive pressure within the liner conduit may increase due to the delivering at 510 and the repeating may include repeating at least the perforating at 520 and the stimulating at 525 responsive to detecting that the pressure within the liner conduit is greater than a threshold pressure at 515.

Ceasing the sealing at 540 may include ceasing the sealing of the annular space based, at least in part, on the occurrence of any suitable event and/or any suitable criteria. As an illustrative, non-exclusive example, the ceasing may include ceasing responsive to completion of the stimulating. As another illustrative, non-exclusive example, the ceasing may include ceasing in preparation for producing a reservoir fluid from the well at 545.

Producing the reservoir fluid from the subterranean formation at 545 may include pumping or otherwise conveying the reservoir fluid from the subterranean formation and to and/or near the surface region using the well. As an illustrative, non-exclusive example, the producing may include flowing the reservoir fluid from the subterranean formation, through the plurality of re-completion perforations, through the annular space, through the plurality of liner perforations, through the liner conduit, through the casing conduit, and to the surface region. As another illustrative, non-exclusive example, the producing may include flowing the reservoir fluid from the subterranean formation, through the plurality of existing perforations, through the annular space, through the plurality of liner perforations, through the liner conduit, through the casing conduit, and to the surface region. As yet another illustrative, non-exclusive example, the producing may include producing using methods 700, which are discussed in more detail herein.

Figure 9:
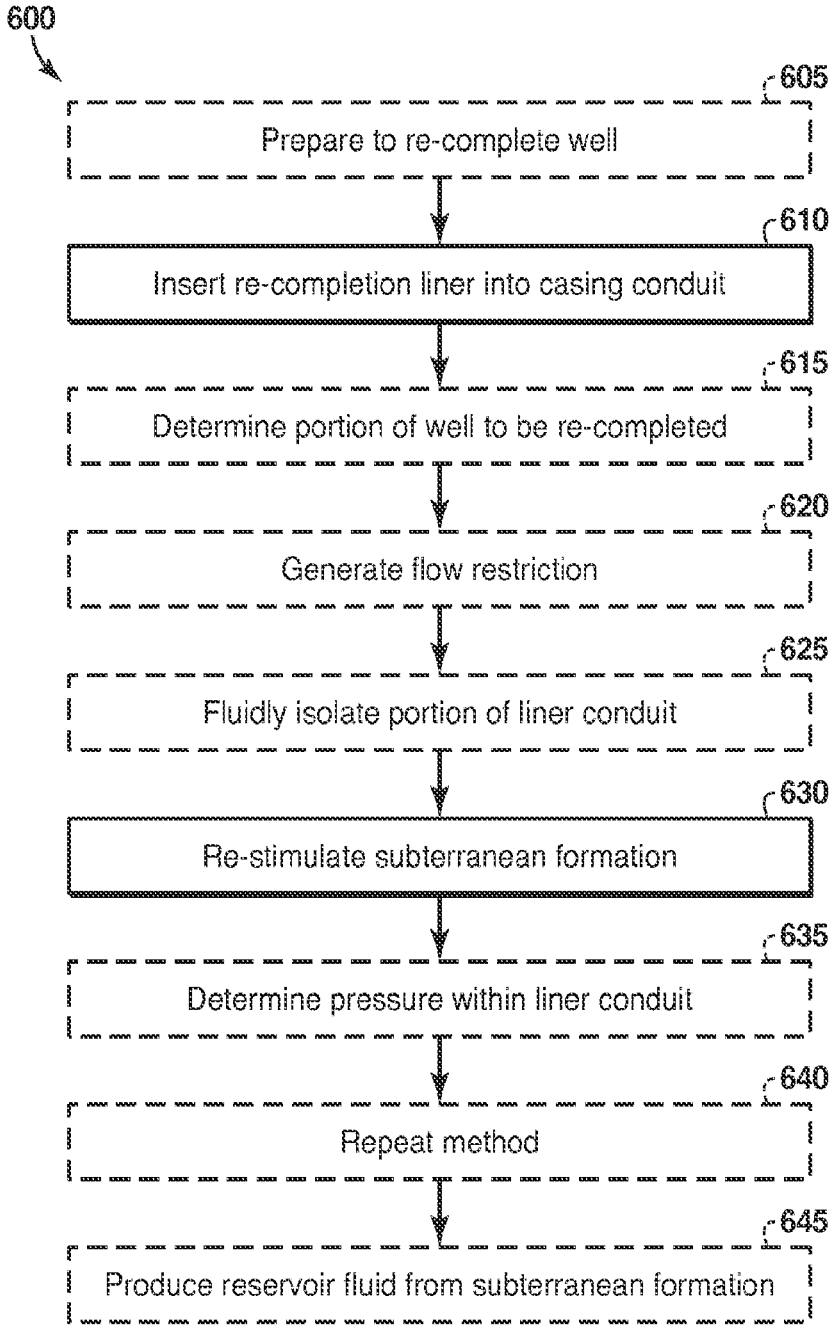
FIG. 9 is a flowchart depicting methods according to the present disclosure of re-completing a well.

FIG. 9 is a flowchart depicting methods 600 according to the present disclosure of re-completing a well that includes a wellbore that extends between a surface region and a subterranean formation and a casing string that extends within the wellbore and defines a casing conduit. The methods may include preparing to re-complete the well at 605 and include inserting a re-completion liner that defines a liner conduit into the casing conduit at 610. The methods optionally further may include determining a portion of the well to be re-stimulated at 615, generating a flow restriction within an annular space that is defined between the re-completion liner and the casing conduit at 620, and/or fluidly isolating a downhole portion of the liner conduit from an uphole portion of the liner conduit at 625. The methods further include re-stimulating the subterranean formation at 630 and optionally may include determining a pressure within the liner conduit at 635, repeating the method at 640, and/or producing a reservoir fluid from the subterranean formation at 645.

Preparing to re-complete the well at 605 may include preparing the well for the inserting at 610. As illustrative, non-exclusive examples, the preparing may include removing an existing liner from the casing conduit, removing debris from the casing conduit, inspecting the casing conduit for damage, and/or repairing the casing conduit prior to the inserting.

Inserting the re-completion liner into the casing conduit at 610 may include inserting the re-completion liner into any suitable portion of the casing conduit, illustrative, non-exclusive examples of which are discussed in more detail herein. As another illustrative, non-exclusive example, the inserting may include hanging off the re-completion liner in a heel of the casing conduit that is uphole from the plurality of existing perforations and extending the re-completion liner within the casing conduit and past a portion, a majority, or all of the existing perforations.

Determining the portion of the well to be re-stimulated may include selecting the portion, or one of a plurality of portions to be re-stimulated, based upon any suitable criteria. As illustrative, non-exclusive examples, the determining may be based, at least in part, on a location of the plurality of existing perforations, a location of an un-stimulated zone of the subterranean formation, and/or a location of an uneconomic zone of the subterranean formation. Illustrative, non-exclusive examples of uneconomic zones of the subterranean formation includes portions of the subterranean formation that do not include a hydrocarbon, include less than a threshold amount of the hydrocarbon, include an undesired hydrocarbon, and/or include water. As another illustrative, non-exclusive example, the determining may include locating a selected re-stimulation perforation, or each of the re-stimulation perforations, at least a threshold distance from a closest existing perforation. Illustrative, non-exclusive examples of the threshold distance include threshold distances of at least 1 meter (m), at least 2 m, at least 3 m, at least 4 m, at least 5 m, at least 10 m, at least 15 m, at least 20 m, at least 25 m, at least 30 m, at least at least 40 m, at least 50 m, at least 75 m, or at least 100 m. As discussed in more detail herein, increasing the distance between the existing perforations and the re-completion perforations (and the respective liner perforations) may decrease a leakage flow within the annular space by increasing a flow resistance within the annular space.

Generating a flow restriction within the annular space at 620 may include the use of any suitable annular space dimensions and/or locating any suitable flow control material and/or flow control device, illustrative, non-exclusive examples of which are discussed in more detail herein, within the annular space to restrict, limit, block, and/or occlude the leakage flow within the annular space. It is within the scope of the present disclosure that the generating may be based, at least in part, on any suitable criteria. As an illustrative, non-exclusive example, the generating may be performed prior to the re-stimulating and/or during the re-inserting. As another illustrative, non-exclusive example, the generating may be performed responsive to the occurrence of an event, or trigger, an illustrative, non-exclusive example of which is discussed in more detail herein with reference to the determining at 635.

As discussed, it is within the scope of the present disclosure that the generating may include permanently restricting the leakage flow. However, it is also within the scope of the present disclosure that the generating may include temporarily restricting the leakage flow and/or subsequently removing the flow restriction. As an illustrative, non-exclusive example, the restricting may include restricting the leakage flow during at least the re-stimulating at 630.

As an illustrative, non-exclusive example, and when the flow control material includes a gel, the locating may include flowing a precursor material into the annular space and crosslinking the precursor material within the annular space to generate the flow restriction. Subsequent to the re-stimulating, the method further may include removing the gel from the annular space, such as by providing a breaker material thereto to decrease the crosslinking thereof and flowing the gel from the annular space.

Fluidly isolating the downhole portion of the liner conduit from the uphole portion of the liner conduit at 625 may include the use of any suitable structure to fluidly isolate the downhole portion from the uphole portion, isolate the uphole portion from the subterranean formation, and/or provide for pressurization of the uphole portion. As an illustrative, non-exclusive example, the fluidly isolating may include setting an isolation device, such as a plug, within the liner conduit.

Re-stimulating the subterranean formation at 630 may include perforating the re-completion liner to create a plurality of liner perforations, perforating the casing string to create a plurality of re-completion perforations, and flowing a completion fluid through the plurality of liner perforations, through the annular space, through the plurality of re-completion perforations, and into the subterranean formation. As an illustrative, non-exclusive example, and as discussed in more detail herein, the perforating may include perforating with a perforation gun and/or an abrasive jet. As another illustrative, non-exclusive example, and as also discussed in more detail herein the flowing the completion fluid may include delivering the completion fluid to the liner conduit at a supply flow rate to generate a positive pressure within the liner conduit, with the positive pressure providing a motive force for the flowing. As another illustrative, non-exclusive example, the re-stimulating may include re-stimulating using methods 500 that are discussed in more detail herein.

It is within the scope of the present disclosure that, as discussed in more detail herein, the annular space may be configured to provide for a finite leakage flow in the longitudinal direction therein. Thus, the method further many include flowing the leakage flow within the annular space during the re-stimulating. When the method includes flowing the leakage flow within the annular space during the re-stimulating, the leakage flow rate may include and/or be any suitable fraction of the supply flow rate. As illustrative, non-exclusive examples, the leakage flow rate may be less than 50%, less than 40%, less than 30%, less than 20%, less than 10%, less than 5%, or less than 1% of the supply flow rate.

Determining the pressure within the liner conduit at 635 may include determining and/or detecting the pressure using any suitable system and/or method, illustrative, non-exclusive examples of which are discussed in more detail herein. It is within the scope of the present disclosure that the determining further may include determining that the pressure within the liner conduit is less than a threshold liner conduit pressure and/or performing the generating at 620 responsive to determining that the pressure within the liner conduit is less than the threshold liner conduit pressure.

As an illustrative, non-exclusive example, and during methods 600, the pressure within the liner conduit may decrease to below the threshold liner conduit pressure due to the presence of the leakage flow within the annular space. Under these conditions, the methods may include initiating the generating at 620 to decrease the leakage flow and increase the pressure within the liner conduit. As an illustrative, non-exclusive example, the generating may include supplying a flow control material, such as a high viscosity liquid, a gel, and/or a granular material, to the annular space responsive to detecting that the pressure within the liner conduit is less than the threshold liner conduit pressure.

Repeating the method at 640 may include repeating any suitable portion of the method. As an illustrative, non-exclusive example, the re-stimulating may include re-stimulating a first zone of the subterranean formation and the repeating may include re-stimulating a second zone of the subterranean formation that is different and/or uphole from the first zone of the subterranean formation.

It is within the scope of the present disclosure that, when the method includes the repeating at 640, the fluidly isolating may include fluidly isolating the liner conduit from the subterranean formation subsequent to re-stimulating the first zone of the subterranean formation but prior to re-stimulating the second zone of the subterranean formation. As an illustrative, non-exclusive example, this may include the use of an isolation device, such as a plug and/or one or more ball sealers, to fluidly isolate at least a portion of the liner conduit from the subterranean formation and/or provide for generation of a positive pressure within the liner conduit.

Producing reservoir fluid from the subterranean formation at 645 may include producing the reservoir fluid from the re-stimulated zones of the subterranean formation and may be substantially similar to the producing at 545 that is discussed in more detail herein. It is within the scope of the present disclosure that the producing further may include producing using methods 700, which are discussed in more detail herein.

Figure 10:
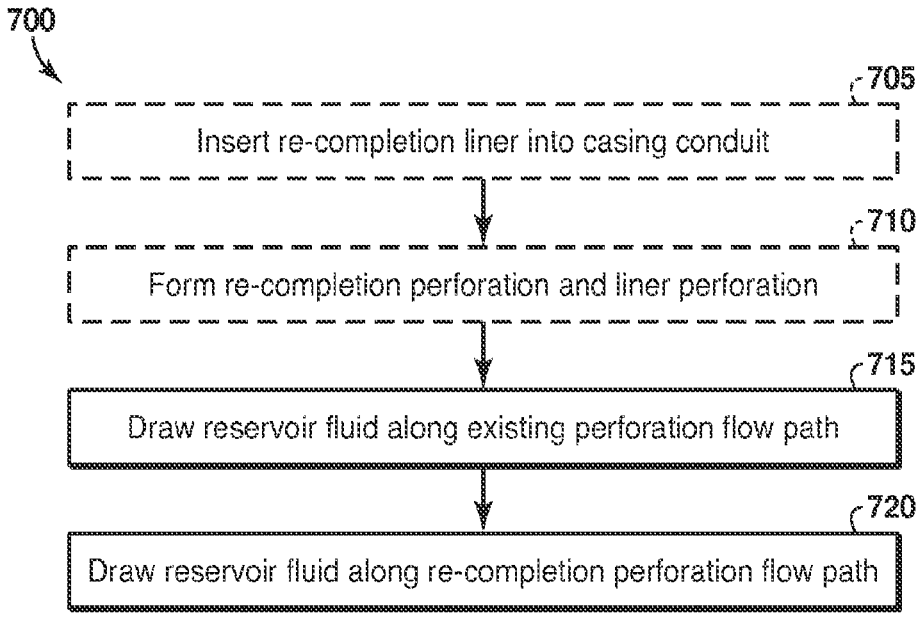
FIG. 10 is a flowchart depicting methods according to the present disclosure of producing a reservoir fluid from a re-completed well.

FIG. 10 is a flowchart depicting methods 700 according to the present disclosure of producing a reservoir fluid from a re-completed well that includes a wellbore that extends between a surface region and a subterranean formation and a casing string that extends within the wellbore. Methods 700 may include inserting a re-completion liner into a casing conduit at 705 and forming a re-completion perforation within the casing conduit and a liner perforation within the liner at 710. The methods further include drawing a reservoir fluid into the liner conduit along an existing perforation flow path at 715 and drawing the reservoir fluid into the liner conduit along a re-completion perforation flow path at 720.

Inserting the re-completion liner into the casing conduit at 705 may include inserting the re-completion liner into a casing conduit that already includes a plurality of existing perforations. Additionally or alternatively, the inserting may include inserting the re-completion liner into the casing conduit subsequent to formation of the plurality of existing perforations within the casing conduit.

Forming the re-completion perforation and the liner perforation at 710 may include forming the liner perforation and the generally aligned re-completion perforation. Additionally or alternatively, the forming may include forming the liner perforation and the re-completion perforation subsequent to the inserting at 705 and/or prior to the drawing at 715 and 720. The forming may be accomplished using any suitable system and/or method, illustrative, non-exclusive examples of which are discussed in more detail herein with respect to the perforating of methods 500 and/or 600.

Drawing the reservoir fluid along the existing perforation flow path at 715 includes drawing the reservoir fluid through the existing perforation, through the annular space, through the re-completion perforation, and into the liner conduit. As discussed in more detail herein, the existing perforation may not be generally aligned with a respective re-completion perforation within the re-completion liner. As such, drawing the reservoir fluid through the annular space and/or drawing the reservoir fluid along the existing perforation flow path may include flowing the reservoir fluid in a direction that is generally parallel to an inner surface of the casing string and/or generally in the longitudinal direction within the annular space. Thus, a length of the existing perforation flow path may be greater than a diameter of the casing conduit, greater than a radial dimension of the annular space, greater than a diameter of the liner conduit, and/or greater than a length of the re-completion perforation flow path.

Drawing the reservoir fluid along the re-completion perforation flow path at 720 includes drawing the reservoir fluid through the re-completion perforation, through the annular space, through the liner perforation, which is generally aligned with the re-completion perforation, and into the liner conduit. As such, drawing the reservoir fluid through the annular space and/or drawing the reservoir fluid along the re-completion perforation flow path may include flowing the reservoir fluid in a direction that is generally perpendicular to the inner surface of the casing string and/or in a generally radial direction within the annular space. Thus, the length of the re-completion perforation flow path may be less than the diameter of the casing conduit, substantially equal to the radial dimension of the annular space, less than the diameter of the liner conduit, and/or less than the length of the existing perforation flow path.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A method of re-stimulating a re-lined well, the method comprising:

delivering a completion fluid to a liner conduit, which is defined by a re-completion liner that extends within a casing conduit, at a supply flow rate to generate a positive pressure within the liner conduit, wherein the casing conduit is defined by a casing string that includes a plurality of existing perforations and extends within a subterranean formation, and further wherein the re-completion liner and the casing string define an annular space therebetween;

perforating the re-completion liner and the casing string to create a plurality of liner perforations and a plurality of re-completion perforations that are generally aligned with respective liner perforations of the plurality of liner perforations; and stimulating the subterranean formation by flowing the completion fluid from the liner conduit, through the plurality of liner perforations, through the annular space, through the respective re-completion perforations, and into the subterranean formation.

A2. The method of paragraph A1, wherein the method further includes sealing the plurality of liner perforations, optionally wherein the sealing includes introducing a sealing agent into the liner conduit, and further optionally wherein the sealing agent includes ball sealers.

A3. The method of paragraph A2, wherein the perforating is performed with a stimulation assembly, wherein the stimulating includes stimulating a first zone of the subterranean formation that is associated with a first region of the re-completion liner, and further wherein the method includes moving the stimulation assembly to a second region of the re-completion liner that is associated with a second zone of the subterranean formation, optionally wherein the second region of the re-completion liner is different, and optionally uphole, from the first region of the re-completion liner.

A4. The method of paragraph A3, wherein the method further includes detecting a detected positive pressure within the liner conduit.

A5. The method of paragraph A4, wherein the plurality of liner perforations is a first plurality of liner perforations, wherein the method further includes repeating the method to create a second plurality of liner perforations within the second region of the re-completion liner and stimulate the second zone of the subterranean formation responsive to determining that the detected positive pressure has exceeded a threshold detected positive pressure.

A6. The method of any of paragraphs A1-A5, wherein the method further includes maintaining the delivering, optionally wherein the maintaining includes delivering the completion fluid during a majority, at least 50%, at least 60%, at least 70%, at least 80%, at least 90%, at least 95%, at least 99%, or all of a time period during which the method is performed, and further optionally wherein the maintaining includes delivering the completion fluid at least one of immediately prior to the perforating, during the perforating, and during the stimulating.

A7. The method of any of paragraphs A1-A6, wherein the stimulating includes at least one of fracturing the subterranean formation and acidizing the subterranean formation, and optionally wherein the completion fluid includes at least one of a stimulant fluid, a fracturing fluid, a proppant, and an acid.

A8. The method of any of paragraphs A1-A7, wherein the stimulating includes flowing the completion fluid at a completion flow rate that is greater than the supply flow rate.

A9. The method of any of paragraphs A1-A8, wherein the delivering is performed prior to the stimulating.

A10. The method of any of paragraphs A1-A9, wherein the flowing is directly responsive to the perforating.

A11. The method of any of paragraphs A1-A10, wherein the perforating is directly responsive to determining that the positive pressure is greater than a threshold positive pressure.

A12. The method of any of paragraphs A1-A11, wherein the simulating includes flowing the completion fluid into the subterranean formation at a/the completion flow rate that is greater than a threshold completion flow rate, optionally wherein the threshold completion flow rate is at least 15 barrels per minute (BPM), at least 20 BPM, at least 25 BPM, at least 30 BPM, at least 35 BPM, or at least 40 BPM.

A13. The method of any of paragraphs A1-A12, wherein the annular space defines a fluid conduit that extends along a portion of a length of the re-completion liner.

A14. The method of paragraph A13, wherein the portion of the length of the re-completion liner includes at least 10%, at least 20%, at least 30%, at least 40%, at least 50%, at least 60%, at least 70%, at least 80%, at least 90%, at least 95%, at least 97.5%, or at least 99% of the length of the re-completion liner.

A15. The method of any of paragraphs A1-A13, wherein the method further includes sealing at least a portion of the annular space prior to the delivering to restrict a fluid flow in a longitudinal direction therethrough, and optionally wherein the sealing includes pumping a cement into the portion of the annular space, optionally wherein the portion of the annular space includes at least 10%, at least 20%, at least 30%, at least 40%, at least 50%, at least 60%, at least 70%, at least 80%, at least 90%, at least 95%, at least 97.5%, or at least 99% of the annular space, and further optionally wherein the portion of the annular space includes less than 90%, less than 80%, less than 70%, less than 60%, less than 50%, less than 40%, less than 30%, less than 20%, less than 10%, less than 5%, or less than 1% of the annular space.

A16. The method of paragraph A15, wherein the sealing includes at least one of permanently sealing the portion of the annular space, sealing the portion of the annular space during the perforating, and sealing the portion of the annular space during the stimulating.

A17. The method of any of paragraphs A15-A16, wherein the method further includes producing a reservoir fluid from the subterranean formation, and optionally wherein the method includes one of maintaining the sealing during the producing and ceasing the sealing during the producing.

A18. The method of any of paragraphs A1-A17, wherein the perforating includes perforating a portion of the re-completion liner that is within a target zone of the subterranean formation, wherein the target zone of the subterranean formation includes a subterranean formation pressure, wherein a portion of the liner conduit that is within the portion of the re-completion liner includes a liner conduit pressure, and further wherein the positive pressure is a difference between the liner conduit pressure and the subterranean formation pressure.

A19. The method of any of paragraphs A1-A18, wherein the positive pressure is at least one of defined relative to a/the subterranean formation pressure and greater than the subterranean formation pressure.

A20. The method of any of paragraphs A1-A19, wherein the delivering includes flowing the completion fluid through the liner conduit and in contact with an internal surface of the re-completion liner.

A21. The method of any of paragraphs A1-A20, wherein the delivering includes maintaining the positive pressure above a lower positive pressure threshold during the stimulating, and optionally wherein the maintaining includes delivering additional completion fluid during the stimulating.

A22. The method of any of paragraphs A1-A21, wherein the plurality of liner perforations includes at least a first liner perforation and a second liner perforation, and further wherein the plurality of re-completion perforations includes at least a first re-completion perforation that is generally aligned with the first liner perforation and a second re-completion perforation that is generally aligned with the second liner perforation.

A23. The method of paragraph A22, wherein the perforating includes creating the first liner perforation and subsequently creating the first re-completion perforation, optionally with a first perforation element.

A24. The method of any of paragraphs A22-A23, wherein the perforating includes creating the second liner perforation and subsequently creating the second re-completion perforation, optionally with a second perforation element.

A25. The method of any of paragraphs A1-A24, wherein the delivering includes delivering the completion fluid to maintain the positive pressure within the liner conduit during the perforating and the stimulating.

A26. The method of any of paragraphs A1-A25, wherein the stimulating includes drawing, directly responsive to the flowing, a fluid from the annular space through the re-completion perforation and into the subterranean formation.

B1. A method of re-completing a well, the method comprising:

inserting a re-completion liner into a casing conduit, which is defined by a casing string that includes a plurality of existing perforations, wherein the re-completion liner defines a liner conduit within the re-completion liner and an annular space between the casing string and the re-completion liner; and re-stimulating a subterranean formation into which the well extends.

B2. The method of paragraph B1, wherein the annular space is configured to provide for a leakage flow in a longitudinal direction therein, and optionally wherein the method further includes flowing a fluid in the longitudinal direction within the annular space during the re-stimulating at a leakage flow rate.

B3. The method of paragraph B2, wherein the re-stimulating includes delivering a completion fluid to the liner conduit at a supply flow rate, wherein the leakage flow rate is a fraction of the supply flow rate, and optionally wherein the fraction of the supply flow rate is less than 50%, less than 40%, less than 30%, less than 20%, less than 10%, less than 5%, or less than 1% of the supply flow rate.

B4. The method of any of paragraphs B2-B3, wherein the method further includes generating a flow restriction within the annular space and restricting a/the leakage flow in a/the longitudinal direction within the annular space, optionally wherein the restricting includes one of decreasing and blocking the leakage flow, and further optionally wherein the generating is performed prior to the re-stimulating.

B5. The method of paragraph B4, wherein, subsequent to the re-stimulating, the method further includes removing the flow restriction to provide for the leakage flow.

B6. The method of paragraph B4, wherein the generating includes maintaining the flow restriction subsequent to the re-stimulating, and optionally wherein the maintaining includes permanently maintaining the flow restriction.

B7. The method of any of paragraphs B4-B6, wherein generating the flow restriction includes sizing the annular space to control the fluid flow in the longitudinal direction therein.

B8. The method of paragraph B7, wherein a radial dimension of the annular space is based, at least in part, on at least one of an inner diameter of the casing string, a viscosity of a fluid that is present within the annular space during the re-stimulating, a length of the re-completion liner, a number of zones of the subterranean formation that will be re-stimulated, a distance between the zones of the subterranean formation that will be re-stimulated, and an average distance between the plurality of existing perforations and a plurality of re-completion perforations that are formed during the re-stimulating.

B9. The method of any of paragraphs B4-B8, wherein generating the flow restriction includes supplying a flow control fluid to the annular space prior to the re-stimulating to control the fluid flow in the longitudinal direction during the re-stimulating.

B10. The method of paragraph B9, wherein the flow control fluid includes at least one of a shear thickening fluid, a Bingham fluid, a Newtonian fluid, a single-component fluid, a multi-component fluid, and a high viscosity fluid that includes a viscosity of at least 10 centipoise (cp), at least 15 cp, at least 20 cp, at least 25 cp, at least 30 cp, at least 35 cp, at least 40 cp, at least 45 cp, or at least 50 cp.

B11. The method of any of paragraphs B4-B10, wherein generating the flow restriction includes locating at least one of a flow control device and a flow control material within the annular space.

B12. The method of paragraph B11, wherein the flow control material includes a gel, and optionally wherein the locating includes flowing a precursor material into the annular space and crosslinking the precursor material within the annular space to generate the gel.

B13. The method of paragraph B12, wherein the method further includes removing the gel from the annular space subsequent to the re-stimulating, and optionally wherein the removing includes supplying a breaker material to the annular space to decrease the crosslinking.

B14. The method of any of paragraphs B11-B13, wherein the flow control device includes a plurality of swellable packers, optionally wherein the plurality of swellable packers is distributed along a length of the annular space, optionally wherein the plurality of swellable packers is attached to an outer surface of the re-completion liner prior to the inserting, and further optionally wherein the generating includes swelling the swellable packers within the annular space.

B15. The method of any of paragraphs B11-B14, wherein the flow control device includes a swellable coating, optionally wherein the swellable coating coats a portion of the outer surface of the re-completion liner, and further optionally wherein the swellable coating is coated on the outer surface of the re-completion liner prior to the inserting.

B16. The method of paragraph B15, wherein the portion of the outer surface of the re-completion liner includes at least a fraction of a length of the re-completion liner, optionally wherein the fraction of the length of the re-completion liner includes at least 50%, at least 60%, at least 70%, at least 80%, at least 90%, at least 95%, or at least 99% of the length of the re-completion liner, and further optionally wherein the swellable coating is one of continuous and discontinuous along the length of the re-completion liner.

B17. The method of any of paragraphs B15-B16, wherein the portion of the outer surface of the re-completion liner includes at least a fraction of a circumference of the re-completion liner, optionally wherein the fraction of the circumference of the re-completion liner includes at least 50%, at least 60%, at least 70%, at least 80%, at least 90%, at least 95%, or at least 99% of the circumference of the re-completion liner, and further optionally wherein the swellable coating is one of continuous and discontinuous around the circumference of the re-completion liner.

B18. The method of any of paragraphs B11-B17, wherein the flow control device includes a hydraulically actuated collar, and optionally wherein the hydraulically actuated collar includes the flow control device of any of paragraphs F1-F6.

B19. The method of paragraph B18, wherein the method further includes expanding the hydraulically actuated collar prior to the re-stimulating, and optionally wherein the expanding includes generating a positive pressure within the liner conduit.

B20. The method of any of paragraphs B11-B19, wherein the flow control material includes a particulate material, wherein the locating includes locating the particulate material within the annular space, and optionally wherein the particulate material includes at least one of a granular material and sand.

B21. The method of any of paragraphs B1-B20, wherein the method further includes producing a reservoir fluid from the subterranean formation.

B22. The method of paragraph B21, wherein the re-stimulating includes creating a plurality of re-completion perforations within the casing string, and further wherein the producing includes flowing the reservoir fluid through the plurality of existing perforations and the plurality of re-completion perforations and into the liner conduit.

B23. The method of any of paragraphs B21-B22, wherein the producing includes producing using the method of any of paragraphs C1-C10.

B24. The method of any of paragraphs B1-B23, wherein the re-stimulating includes perforating the re-completion liner to create a plurality of liner perforations and perforating the casing string to create a/the plurality of re-completion perforations, and further wherein the re-stimulating includes flowing a completion fluid through the plurality of liner perforations, through the annular space, through the plurality of re-completion perforations, and into the subterranean formation to stimulate the subterranean formation.

B25. The method of paragraph B24, wherein the perforating includes perforating with at least one of a perforation gun and an abrasive jet.

B26. The method of any of paragraphs B24-B25, wherein the completion fluid includes at least one of a stimulant fluid, a fracturing fluid, a proppant, and an acid.

B27. The method of any of paragraphs B1-B26, wherein the re-stimulating includes re-stimulating using the method of any of paragraphs A1-A26.

B28. The method of any of paragraphs B24-B27 when dependent from any of paragraphs B4-B23, wherein, during the flowing, the method further includes determining that a pressure within the liner conduit is less than a threshold liner conduit pressure, and further wherein the generating is responsive to the determining.

B29. The method of any of paragraphs B1-B28, wherein the method further includes determining a location for the re-stimulating, optionally wherein the determining is based, at least in part, on at least one of a location of the plurality of existing perforations, a location of an un-stimulated zone of the subterranean formation, and a location of an uneconomic zone of the subterranean formation that optionally at least one of does not includes a hydrocarbon, includes less than a threshold amount of the hydrocarbon, includes an undesired hydrocarbon, and includes water.

B30. The method of paragraph B29, wherein the determining includes locating a re-stimulation perforation of the plurality of re-stimulation perforations that is created during the re-stimulating at least a threshold distance from a closest existing perforation, and optionally wherein the threshold distance is greater than 10 meters, greater than 15 meters, greater than 20 meters, greater than 25 meters, greater than 30 meters, greater than 35 meters, or greater than 40 meters.

B31. The method of any of paragraphs B1-B30, wherein the well does not include cement within the annular space.

B32. The method of any of paragraphs B1-B31, wherein, prior to the inserting, the method includes at least one of removing an existing liner from the casing conduit, removing debris from the casing conduit, and inspecting the casing conduit for damage.

B33. The method of any of paragraphs B1-B32, wherein inserting the re-completion liner includes hanging off the re-completion liner in a heel of the casing conduit that is uphole from the plurality of existing perforations.

B34. The method of any of paragraphs B1-B33, wherein, prior to the re-stimulating, the method further includes fluidly isolating a downhole portion of the liner conduit from an uphole portion of the liner conduit, optionally wherein the fluidly isolating includes setting a plug within the liner conduit, and further optionally wherein the setting includes setting the plug near a terminal end of the liner conduit.

B35. The method of any of paragraphs B1-B34, wherein the re-stimulating includes re-stimulating a first zone of the subterranean formation, and further wherein the method includes re-stimulating a second zone of the subterranean formation, optionally wherein the first zone is different from the second zone, and further optionally wherein the first zone is downhole from the second zone.

C1. A method of producing a reservoir fluid from a re-completed well, the method comprising:

drawing the reservoir fluid along an existing perforation flow path from a subterranean formation, through an existing perforation in a casing string, through an annular space that is defined between the casing string and a re-completion liner that extends within a casing conduit of the casing string, through a liner perforation in the re-completion liner, and into a liner conduit that is defined by the re-completion liner; and drawing the reservoir fluid along a re-completion perforation flow path from the subterranean formation, through a re-completion perforation in the casing string, through the annular space, through the liner perforation, and into the liner conduit, wherein the liner perforation is generally aligned with the re-completion perforation.

C2. The method of paragraph C1, wherein the existing perforation is not generally aligned with a respective re-completion perforation.

C3. The method of any of paragraphs C1-C2, wherein the re-completion perforation flow path is at least one of generally perpendicular to an inner surface of the casing string, generally in a radial direction, and shorter than a diameter of the casing conduit.

C4. The method of any of paragraphs C1-C3, wherein the existing perforation flow path is at least one of generally parallel to an/the inner surface of the casing string, generally in a longitudinal direction, longer than a/the diameter of the casing conduit, and longer than a/the re-completion perforation flow path.

C5. The method of any of paragraphs C1-C4, wherein the method further includes forming the re-completion perforation and the liner perforation using the method of any of paragraphs A1-A26.

C6. The method of any of paragraphs C1-C5, wherein the re-completed well includes the well of any of paragraphs E1-E24.

C7. The method of any of paragraphs C1-C6, wherein the method further includes re-completing the well using the method of any of paragraphs B1-B35, optionally wherein the re-completing is performed prior to the drawing the reservoir fluid into the liner conduit along the existing perforation flow path, and further optionally wherein the re-completing is performed prior to the drawing the reservoir fluid into the liner conduit along the re-completion perforation flow path.

C8. The method of any of paragraphs C1-C7, wherein the method further includes inserting the re-completion liner into the casing conduit.

C9. The method of paragraph C8, wherein the existing perforation is present within the casing conduit during the inserting.

C10. The method of any of paragraphs C8-C9, wherein the method further includes forming the re-completion perforation and the liner perforation subsequent to the inserting.

D1. The method of any of paragraphs A1-C10, wherein the casing string extends within a wellbore.

D2. The method of any of paragraphs A1-D1, wherein the wellbore extends between a surface region and the subterranean formation.

D3. The method of any of paragraphs A1-D2, wherein the casing conduit is defined within the casing string.

D4. The method of any of paragraphs A1-D3, wherein the liner conduit is defined within the re-completion liner.

D5. The method of any of paragraphs A1-D4, wherein the re-completion liner is present within a portion of the casing conduit, and optionally wherein the portion of the casing conduit includes at least one of a perforated portion of the casing conduit, an entire perforated portion of the casing conduit, a portion of the casing conduit that is present within a pay zone of the subterranean formation, a horizontal portion of the casing conduit, a vertical portion of the casing conduit, and a deviated portion of the casing conduit.

D6. The method of any of paragraphs A1-D5, wherein the subterranean formation includes at least one of a/the reservoir fluid and a hydrocarbon, and optionally wherein the hydrocarbon includes at least one of tight gas, tight oil, shale gas, shale oil, coal bed methane, a liquid hydrocarbon, and a gaseous hydrocarbon.

E1. A well, comprising:

a wellbore that extends between a surface region and a subterranean formation;

a casing string that extends within the wellbore, defines a casing conduit within the casing string, and includes a plurality of existing perforations and a plurality of re-completion perforations; and a re-completion liner that extends within the casing conduit, defines a liner conduit within the re-completion liner, defines an annular space between the casing string and the re-completion liner, and includes a plurality of liner perforations, wherein each of the plurality of liner perforations is generally aligned with a respective one of the plurality of re-completion perforations, wherein the annular space provides fluid communication between the plurality of liner perforations and the plurality of re-completion perforations, and further wherein the annular space provides fluid communication between the plurality of existing perforations and the plurality of liner perforations.

E2. The well of paragraph E1, wherein the well further includes a stimulation assembly that is present within the liner conduit and is configured to form the plurality of liner perforations and the plurality of re-completion perforations.

E3. The well of any of paragraphs E1-E2, wherein the well further includes a pumping assembly that is configured to provide a completion fluid to the liner conduit to at least one of pressurize the liner conduit and stimulate the subterranean formation.

E4. The well of paragraph E3 when dependent from paragraph D2, wherein the well further includes a controller configured to control the operation of the stimulation assembly and the pumping assembly using the method of any of paragraphs A1-A26.

E5. The well of any of paragraphs E1-E4, wherein the annular space is sized to control a fluid flow in a longitudinal direction therein.

E6. The well of paragraph E5, wherein a radial dimension of the annular space is selected based, at least in part, on at least one of an inner diameter of the casing string, a length of the re-completion liner, an average distance between the plurality of existing perforations and the plurality of liner perforations, and a viscosity of an annulus fluid that is present within the annular space during completion of the well.

E7. The well of any of paragraphs E1-E6, wherein the annular space includes a flow control device, and optionally a plurality of flow control devices, wherein the flow control device is configured to restrict a/the fluid flow in a/the longitudinal direction within the annular space.

E8. The well of paragraph E7, wherein the flow control device is configured to permanently restrict the fluid flow within the annular space.

E9. The well of paragraph E7, wherein the flow control device is configured to temporarily restrict the fluid flow within the annular space, and optionally wherein the flow control device is configured to temporarily restrict the fluid flow within the annular space during re-completion of the well.

E10. The well of any of paragraphs E7-E9, wherein the flow control device is configured to one of decrease the fluid flow and block the fluid flow.

E11. The well of any of paragraphs E7-E10, wherein the flow control device includes a flow control fluid that is present within the annular space, and optionally wherein the flow control fluid includes at least one of a shear thickening fluid, a Bingham fluid, a Newtonian fluid, a single-component fluid, a multi-component fluid, and a high viscosity fluid that optionally includes a viscosity of at least 10 centipoise (cp), at least 15 cp, at least 20 cp, at least 25 cp, at least 30 cp, at least 35 cp, at least 40 cp, at least 45 cp, or at least 50 Cp.

E12. The well of any of paragraphs E7-E11, wherein the flow control device includes a crosslinked gel.

E13. The well of any of paragraphs E7-E12, wherein the flow control device includes a swellable packer, optionally wherein the swellable packer is attached to an outer surface of the re-completion liner prior to the re-completion liner being inserted into the casing conduit, and further optionally wherein the flow control device includes a plurality of swellable packers that are optionally distributed along a length of the annular space.

E14. The well of any of paragraphs E7-E13, wherein the flow control device includes a swellable coating, optionally wherein the swellable coating coats a portion of an outer surface of the re-completion liner, and further optionally wherein the swellable coating is coated on the outer surface of the re-completion liner prior to the re-completion liner being inserted into the casing conduit.

E15. The well of paragraph E14, wherein the portion of the outer surface of the re-completion liner includes at least a fraction of a length of the re-completion liner, optionally wherein the fraction of the length of the re-completion liner includes at least 50%, at least 60%, at least 70%, at least 80%, at least 90%, at least 95%, or at least 99% of the length of the re-completion liner, and further optionally wherein the swellable coating is one of continuous and discontinuous along the length of the re-completion liner.

E16. The well of any of paragraphs E14-E15, wherein the portion of the outer surface of the re-completion liner includes at least a fraction of a circumference of the re-completion liner, optionally wherein the fraction of the circumference of the re-completion liner includes at least 50%, at least 60%, at least 70%, at least 80%, at least 90%, at least 95%, or at least 99% of the circumference of the re-completion liner, and further optionally wherein the swellable coating is one of continuous and discontinuous around the circumference of the re-completion liner.

E17. The well of any of paragraphs E7-E16, wherein the flow control device includes a hydraulically actuated collar that is configured to restrict the fluid flow upon pressurization of the liner conduit.

E18. The well of any of paragraphs E7-E17, wherein the flow control device includes the flow control device of any of paragraphs F1-F6.

E19. The well of any of paragraphs E7-E18, wherein the flow control device includes a particulate material, and optionally wherein the particulate material includes at least one of a granular material and sand.

E20. The well of any of paragraphs E1-E19, wherein an average distance between a respective one of the plurality of existing perforations and a closest one of the plurality of liner perforations is at least a threshold multiple greater than an average distance between a respective one of the plurality of re-completion perforations and a respective generally aligned one of the plurality of liner perforations, optionally wherein the threshold multiple is 2 times, 3 times, 4 times, 5 times, 6 times, 8 times, 10 times, 15 times, 20 times, 25 times, 50 times, 75 times, 100 times, 250 times, 500 times, or 1000 times greater than the average distance between the respective one of the plurality of re-completion perforations and the respective generally aligned one of the plurality of liner perforations.

E21. The well of any of paragraphs E1-E20, wherein the average distance between a/the respective one of the plurality of existing perforations and a/the closest one of the plurality of liner perforations is at least one of greater than a diameter of the casing conduit, greater than a diameter of the liner conduit, greater than a thickness of the annular space, and greater than a threshold average distance, and optionally wherein the threshold average distance is at least 1 meter (m), at least 2 m, at least 3 m, at least 4 m, at least 5 m, at least 10 m, at least 15 m, at least 20 m, at least 25 m, at least 30 m, at least 40 m, at least 50 m, at least 75 m, or at least 100 m.

E22. The well of any of paragraphs E1-E21, wherein a distance between a given re-completion perforation of the plurality of re-completion perforations and a respective generally aligned liner perforation of the plurality of liner perforations is at least one of less than a diameter of the casing conduit, less than a diameter of the liner conduit, and substantially equal to a thickness of the annular space.

E23. The well of any of paragraphs E1-E23, wherein the re-completion liner is present within a portion of the casing conduit, and optionally wherein the portion of the casing conduit includes at least one of a perforated portion of the casing conduit, an entire perforated portion of the casing conduit, a portion of the casing conduit that is present within a pay zone of the subterranean formation, a horizontal portion of the casing conduit, a vertical portion of the casing conduit, and a deviated portion of the casing conduit.

E24. The well of any of paragraphs E1-E23, wherein the subterranean formation includes at least one of a/the reservoir fluid and a hydrocarbon, and optionally wherein the hydrocarbon includes at least one of tight gas, tight oil, shale gas, shale oil, coal bed methane, a liquid hydrocarbon, and a gaseous hydrocarbon.

F1. A flow control device that is configured to selectively restrict a fluid flow in an annular space that is defined between a casing string and a liner that is present within the casing string and defines a liner conduit, the flow control device comprising:

a body that defines a portion of the liner conduit and a portion of an inner bound of the annular space; and a sealing structure that includes a first surface and opposed second surface, wherein the first surface forms a portion of the inner bound of the annular space, wherein the second surface is in fluid communication with the liner conduit, and further wherein the sealing structure is configured to transition from a contracted configuration, wherein the sealing structure does not restrict the fluid flow, to a sealing configuration, wherein the sealing structure restricts the fluid flow, when a pressure within the liner conduit is greater than a pressure within the annular space by at least a threshold pressure differential.

F2. The flow control device of paragraph F1, wherein the body includes a first flange that is configured to operatively attach to a first liner segment of the liner and a second flange that is configured to operatively attach to a second liner segment of liner.

F3. The flow control device of any of paragraphs F1-F2, wherein the body includes an orifice that provides the fluid communication between the liner conduit and the second surface.

F4. The flow control device of any of paragraphs F1-F3, wherein the sealing structure is a resilient sealing structure that is configured to return to the contracted configuration when the pressure within the liner conduit is not greater than the pressure within the annular space by at least the threshold pressure differential.

F5. The flow control device of any of paragraphs F1-F3, wherein the sealing structure is configured to remain in the sealing configuration once transitioned thereto, and optionally wherein the sealing structure is configured to remain in the sealing configuration even if the pressure within the liner conduit decreases to a pressure that is not greater than the pressure within the annular space by at least the threshold pressure differential.

F6. The flow control device of any of paragraphs F1-F5, wherein the sealing structure is formed from at least one of rubber, a polymer, an elastomer, a plastic, and a metal.

F7. A liner, comprising:

a first liner segment;

a second liner segment; and the flow control device of any of paragraphs F1-F6, wherein the flow control device is operatively attached to the first liner segment and the second liner segment, and further wherein the liner conduit is defined within the first liner segment, the second liner segment, and the flow-control device.

F8. The liner of paragraph F7, wherein the liner includes a plurality of flow control devices and a plurality of liner segments, wherein each of the plurality of flow control devices is operatively attached to two of the plurality of liner segments.

G1. The use of any of the methods of any of paragraphs A1-D10 with any of the wells of any of paragraphs E1-E24, any of the flow control devices of any of paragraphs F1-F6, or any of the liners of any of paragraphs F7-F8.

G2. The use of any of the wells of any of paragraphs E1-E24, any of the flow control devices of any of paragraphs F1-F6, or any of the liners of any of paragraphs F7-F8 with any of the methods of any of paragraphs A1-D10.

G3. The use of any of the methods of any of paragraphs A1-D10, any of the wells of any of paragraphs E1-E24, any of the flow control devices of any of paragraphs F1-F6, or any of the liners of any of paragraphs F7-F8 to re-complete a well.

G4. The use of any of the methods of any of paragraphs A1-D10, any of the wells of any of paragraphs E1-E24, any of the flow control devices of any of paragraphs F1-F6, or any of the liners of any of paragraphs F7-F8 to stimulate a subterranean formation.

G5. The use of any of the methods of any of paragraphs A1-D10, any of the wells of any of paragraphs E1-E24, any of the flow control devices of any of paragraphs F1-F6, or any of the liners of any of paragraphs F7-F8 to produce hydrocarbons from a subterranean formation.

G6. The use of an unsealed annular space during re-completion of a well.

G7. The use of a flow control device to control a fluid flow within an annular space during re-completion of a well.

G8. The use of a designed annular space to control a fluid flow therein during re-completion of a well.

PCT1. A method of re-stimulating a re-lined well, the method comprising:

delivering a completion fluid to a liner conduit, which is defined by a re-completion liner that extends within a casing conduit, at a supply flow rate to generate a positive pressure within the liner conduit, wherein the casing conduit is defined by a casing string that includes a plurality of existing perforations and extends within a subterranean formation, and further wherein the re-completion liner and the casing string define an annular space therebetween;

perforating the re-completion liner and the casing string to create a plurality of liner perforations and a plurality of re-completion perforations that are generally aligned with respective liner perforations of the plurality of liner perforations; and stimulating the subterranean formation by flowing the completion fluid from the liner conduit, through the plurality of liner perforations, through the annular space, through the respective re-completion perforations, and into the subterranean formation at a completion flow rate that is greater than the supply flow rate, wherein the delivering is performed prior to the perforating, and further wherein the flowing is directly responsive to the perforating.

PCT2. The method of paragraph PCT1, wherein the method further includes sealing the plurality of liner perforations.

PCT3. The method of paragraph PCT2, wherein the perforating is performed with a stimulation assembly, wherein the stimulating includes stimulating a first zone of the subterranean formation that is associated with a first region of the re-completion liner, and further wherein the method includes moving the stimulation assembly to a second region of the re-completion liner that is associated with a second zone of the subterranean formation.

PCT4. The method of paragraph PCT3, wherein the method further includes detecting a detected positive pressure within the liner conduit, wherein the plurality of liner perforations is a first plurality of liner perforations, wherein the method further includes repeating the method to create a second plurality of liner perforations within the second region of the re-completion liner and stimulate the second zone of the subterranean formation responsive to determining that the detected positive pressure has exceeded a threshold detected positive pressure.

PCT5. The method of any of paragraphs PCT1-PCT4, wherein the delivering is performed prior to the stimulating, and further wherein the method includes maintaining the delivering immediately prior to the perforating, during the perforating, and during the stimulating.

PCT6. The method of any of paragraphs PCT1-PCT5, wherein the perforating is directly responsive to determining that the positive pressure is greater than a threshold positive pressure.

PCT7. The method of any of paragraphs PCT1-PCT6, wherein the method further includes sealing at least a portion of the annular space prior to the delivering to restrict a fluid flow in a longitudinal direction therethrough, and further wherein the method includes producing a reservoir fluid from the subterranean formation and ceasing the sealing during the producing.

PCT8. The method of any of paragraphs PCT1-PCT7, wherein the delivering includes maintaining the positive pressure above a lower positive pressure threshold during the stimulating by delivering additional completion fluid during the stimulating.

PCT9. The method of any of paragraphs PCT1-PCT8, wherein the stimulating includes drawing, directly responsive to the flowing, a fluid from the annular space through the re-completion perforation and into the subterranean formation.

PCT10. A method of re-completing a well, the method comprising:

inserting a re-completion liner into a casing conduit, which is defined by a casing string that includes a plurality of existing perforations, wherein the re-completion liner defines a liner conduit within the re-completion liner and an annular space between the casing string and the re-completion liner;

generating a flow restriction within the annular space to restrict a flow of a fluid in a longitudinal direction within the annular space;

re-stimulating a subterranean formation into which the well extends; and removing the flow restriction to provide for flow of the fluid in the longitudinal direction within the annular space.

PCT11. The method of paragraph PCT10, wherein generating the flow restriction includes at least one of sizing the annular space to control the fluid flow in the longitudinal direction therein, supplying a flow control fluid to the annular space, locating a flow control device within the annular space, and locating a flow control material within the annular space.

PCT12. The method of any of paragraphs PCT10-PCT11, wherein generating the flow restriction includes locating at least one of a gel, a swellable packer, a swellable coating, a hydraulically actuated collar, and a granular material within the annular space.

PCT13. The method of any of paragraphs PCT10-PCT12, wherein the re-stimulating includes creating a plurality of re-completion perforations within the casing string, and further wherein the method includes producing a reservoir fluid from the subterranean formation by flowing the reservoir fluid through the plurality of existing perforations and the plurality of re-completion perforations and into the liner conduit.

PCT14. The method of any of paragraphs PCT10-PCT13, wherein the re-stimulating includes perforating the re-completion liner to create a plurality of liner perforations and perforating the casing string to create a plurality of re-completion perforations, wherein the re-stimulating includes flowing a completion fluid through the plurality of liner perforations, through the annular space, through the plurality of re-completion perforations, and into the subterranean formation to stimulate the subterranean formation, wherein, during the flowing, the method further includes determining that a pressure within the liner conduit is less than a threshold liner conduit pressure, and further wherein the generating is responsive to the determining.

PCT15. A method of producing a reservoir fluid from a re-completed well, the method comprising:

drawing the reservoir fluid along an existing perforation flow path from a subterranean formation, through an existing perforation in a casing string, through an annular space that is defined between the casing string and a re-completion liner that extends within a casing conduit of the casing string, through a liner perforation in the re-completion liner, and into a liner conduit that is defined by the re-completion liner; and drawing the reservoir fluid along a re-completion perforation flow path from the subterranean formation, through a re-completion perforation in the casing string, through the annular space, through the liner perforation, and into the liner conduit, wherein the liner perforation is generally aligned with the re-completion perforation.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of re-stimulating a re-lined well, the method comprising:

delivering a completion fluid to a liner conduit, which is defined by a re-completion liner that extends within a casing conduit, at a supply flow rate to generate a positive pressure within the liner conduit, wherein the casing conduit is defined by a casing string that includes a plurality of existing perforations and extends within a subterranean formation, and further wherein the re-completion liner and the casing string define an annular space having a determined cross-sectional area and comprising an annular fluid therebetween;

delivering a portion of the completion fluid into the annular space as the annular fluid;

perforating the re-completion liner and the casing string to create a plurality of liner perforations and a plurality of casing re-completion perforations that are each radially aligned with a respective one of the plurality of liner perforations, wherein generating the positive pressure comprises considering the determined cross-sectional area of the annular space and generating the positive pressure within the liner conduit with sufficient velocity to create a venturi effect radially across the annular space immediately subsequent to perforating the re-completion liner, thereby stimulating the subterranean formation by flowing the completion fluid at sufficient velocity from the liner conduit, through the plurality of liner perforations, radially across the annular space, through the respective re-completion perforations, and into the subterranean formation at a completion flow rate that is at least initially greater than the supply flow rate, wherein the delivering is performed prior to the perforating, and further wherein the flowing is directly responsive to the perforating, and further wherein the venturi effect draws at least another portion of the annular fluid from the annular space, through the plurality of casing recompletion perforations and into the subterranean formation.

2. The method of claim 1, wherein the method further includes sealing the plurality of liner perforations.

3. The method of claim 2, wherein the perforating is performed with a stimulation assembly, wherein the stimulating includes stimulating a first zone of the subterranean formation that is associated with a first region of the re-completion liner, and further wherein the method includes moving the stimulation assembly to a second region of the re-completion liner that is associated with a second zone of the subterranean formation.

4. The method of claim 3, wherein the method further includes detecting the positive pressure within the liner conduit.

5. The method of claim 4, wherein the plurality of liner perforations is a first plurality of liner perforations, wherein the method further includes repeating the method to create a second plurality of liner perforations within the second region of the re-completion liner and stimulate the second zone of the subterranean formation responsive to determining that the detected positive pressure has exceeded a threshold detected positive pressure.

6. The method of claim 1, wherein the method further includes maintaining the delivering immediately prior to the perforating, during the perforating, and during the stimulating.

7. The method of claim 1, wherein the delivering is performed prior to the stimulating.

8. The method of claim 1, wherein the perforating is directly responsive to determining that the positive pressure is greater than a threshold positive pressure.

9. The method of claim 1, wherein the annular space defines a fluid conduit that extends along at least 80% of a length of the re-completion liner.

10. The method of claim 1, wherein the method further includes sealing at least a portion of the annular space prior to the delivering to restrict a fluid flow in a longitudinal direction therethrough.

11. The method of claim 10, wherein the method further includes producing a reservoir fluid from the subterranean formation and ceasing the sealing during the producing.

12. The method of claim 1, wherein the delivering includes maintaining the positive pressure above a lower positive pressure threshold during the stimulating by delivering additional completion fluid during the stimulating.

13. The method of claim 1, wherein the stimulating includes drawing, directly responsive to the flowing, a fluid from the annular space through the re-completion perforation and into the subterranean formation.

* * * * *